US011608095B2

(12) United States Patent
Brook et al.

(10) Patent No.: US 11,608,095 B2
(45) Date of Patent: Mar. 21, 2023

(54) KNUCKLE PIN

(71) Applicant: Pennsy Corporation, West Chester, PA (US)

(72) Inventors: Zachary Ryan Brook, Leola, PA (US); Manuel Tavares, Doylestown, PA (US); Aaron Stern, West Chester, PA (US); Wayne H. Murphy, Pottstown, PA (US)

(73) Assignee: Pennsy Corporation, West Chester, PA (US)

( * ) Notice: Subject to any disclaimer, the term of this patent is extended or adjusted under 35 U.S.C. 154(b) by 445 days.

(21) Appl. No.: 16/775,217

(22) Filed: Jan. 28, 2020

(65) Prior Publication Data

US 2020/0239046 A1 Jul. 30, 2020

Related U.S. Application Data

(60) Provisional application No. 62/797,977, filed on Jan. 29, 2019.

(51) Int. Cl.
*B61G 7/00* (2006.01)
*B61G 3/04* (2006.01)

(52) U.S. Cl.
CPC ..... *B61G 7/00* (2013.01); *B61G 3/04* (2013.01)

(58) Field of Classification Search
CPC ... B61G 3/00; B61G 3/04; B61G 3/28; B61G 3/30
See application file for complete search history.

(56) References Cited

U.S. PATENT DOCUMENTS

| | | | | |
|---|---|---|---|---|
| 5,145,076 | A * | 9/1992 | Murphy | B61G 3/04 384/624 |
| 5,630,519 | A | 5/1997 | Burke et al. | |
| 5,736,088 | A | 4/1998 | Burke et al. | |
| 6,488,163 | B1 | 12/2002 | Wurzer et al. | |
| 8,910,808 | B2 * | 12/2014 | Halford | B61G 7/00 213/155 |
| 11,305,792 | B2 | 4/2022 | Hankinson | |
| 2009/0308830 | A1 | 12/2009 | Hanaway | |
| 2014/0110368 | A1 | 4/2014 | Wang | |
| 2019/0389495 | A1 | 12/2019 | Hankinson | |

* cited by examiner

*Primary Examiner* — Robert J McCarry, Jr.
(74) *Attorney, Agent, or Firm* — Bonini IP Law, LLC; Frank J. Bonini, Jr.

(57) ABSTRACT

A knuckle pin, coupling system, and method for producing a knuckle pin are provided, the knuckle pin having a cylindrical body with a longitudinal slot therein separating vertical edges of the cylindrical body, with one or more first retaining elements that span outward of the cylindrical body, and a second retainer that includes one or more of opposing apertures, and bendable legs. A method for producing the knuckle pin is provided, where a blank is stamped into a workpiece that corresponds to the pin to be produced, and the stamped workpiece is rolled to produce the pin with the slot.

21 Claims, 34 Drawing Sheets

KNUCKLE PIN

CROSS-REFERENCE TO RELATED APPLICATION

This application claims priority to U.S. Provisional Patent Application Ser. No. 62/797,977, filed on Jan. 29, 2019, the complete contents of which is herein incorporated by reference.

BACKGROUND OF THE INVENTION

1. Field of the Invention

The present invention relates to the field of coupler knuckles for railcars, and more particularly to an improved coupler knuckle pin.

2. Brief Description of the Related Art

The knuckle pin is a structure that is used to retain the coupler knuckle onto the coupler head. Knuckle pins have traditionally been constructed from metal, such as, steel, and which typically is a solid bar with a head at one end. Typically, the pin extends through a pin bore in the knuckle body, and passes through bores of upper and lower coupler pivot flanges which are positioned at opposite ends of the knuckle when the knuckle is installed on the coupler head. The pin traditionally has a head at one end and through gravity, is carried on the coupler to secure the knuckle in a pivotal arrangement so the knuckle may pivot to couple and uncouple with an adjacent knuckle carried on another coupler or railcar.

Knuckle pins are known, and a typical knuckle pin may have a bore transversely provided across the diameter of the pin, at the bottom. When the pin is installed to secure a knuckle to a coupler, the lower end of the pin with the bore extends beyond the coupler lug. Cotter pins have been previously used to retain the knuckle pin within the coupling arrangement. In many instances, continued motion of the railroad cars often wears into a specific area of the pin which can cause fatigue and breakage of the cotter pin material. In addition, a disadvantage of using a cotter pin to secure the pivot pin within the railroad coupler is that installing or removing the cotter pin can be difficult and dangerous to the railroad worker. An attempt has been made to provide an alternative to a cotter pin, by providing a retractable, spring-loaded retainer that is disposed in a cylindrical slot positioned proximate to the second end of the pin, and which extends through an exterior surface of the pin shank generally diametrically and terminating before the opposing diametric exterior surface of the shank. An example of this retainer is disclosed in US Patent application 2009/0308830A1. Another example of an attempt to provide a locking feature is disclosed in U.S. Pat. No. 5,145,076, which provides a plastic knuckle pin that has a self-locking feature and is disclosed to bend when in operation. In addition, U.S. Pat. No. 5,630,519 discloses a plastic knuckle pin constructed to have a symmetrical pattern of slots or holes extending on opposite sides of the pin shaft, and provides self-locking coating legs. Plastic, however has been difficult to implement, as the '519 patent discloses that there are problems with the material matrix of the formed plastic knuckle pin, such as that disclosed in the '076 patent. Though lighter in weight than the solid steel pin, and pliable in response to forces imparted on the pin, such as, for example, by out-of-tolerance or misaligned coupler system components, the plastic knuckle pins have drawbacks.

U.S. Pat. No. 6,488,163B1 discloses a knuckle pin for use in a knuckle pin aperture of a rail car coupler. The '163 knuckle pin has a generally cylindrical body with a longitudinal slot that extends between the first end of the body and a second end of the body. The '163 pin has a retaining element coupled to the first end of the body which is disclosed to be operable to retain the body in the knuckle pin aperture.

A need exists for an improved knuckle pin that can withstand forces and be retained on the coupling assembly.

SUMMARY OF THE INVENTION

A knuckle pin, coupling system, and method for producing a knuckle pin are provided. The knuckle pin is constructed from a suitable metal, such as, steel, and has a body that is designed to flex when handling loads. The flexure locations are designed along the length of the knuckle pin.

According to preferred embodiments, the knuckle pin outer diameter may be maintained during coupling activities, such as, for example, when pivoting of the knuckle carried on the coupler takes place. This provides the loading forces to be handled by, or distributed to, the coupler lugs, instead of having the majority of this force be absorbed by the pin, as the knuckle pins are not designed to handle these force loads. The present pin is designed to be able to flex so that loads are directed to the coupler pivot lugs, yet, be able to maintain its outer diameter during coupling operations, where the knuckle and coupler (and other coupling system components) are engaged in pivoting action.

The knuckle pin also permits the reduction of the outside diameter when forces are received during traveling of the rail car on a track, so that the force loads are handled by or maximized to be handled by the coupler lugs, as intended by the coupling system. According to some embodiments, a knuckle pin is provided having retaining features that facilitate retention of the knuckle with the coupling assembly components, such as the knuckle and coupler. According to some embodiments, the knuckle retaining feature may include one or more elements at the upper portion of the pin that are wider than the pin body, and, preferably wider than the pin bore of the coupler lug (e.g., such as the upper coupler lug bore through which the pin may be inserted when installed).

Embodiments of the pin may include a retaining feature that is provided at the lower portion of the pin. According to some embodiments, the retaining portion may include opposing apertures that may receive a cotter pin or key therethrough. According to some embodiments, the retaining portion at the lower portion or end of the pin may include a retainer comprising one or more movable elements that may be moved to a retaining position where the one or more movable element retains the pin against being pulled out of the pin bore (e.g., through upward movement).

According to some embodiments, the retainer at the pin bottom may comprise both, the movable elements, and opposing bores, which may be provided in the one or more movable elements, thereby providing multiple options for the user to determine whether to retain the pin in the coupling assembly using the movable element or elements, or by installing a cotter pin through the apertures.

According to some embodiments, the knuckle pin is has a body with a longitudinal slot or separation spanning the length of the pin.

According to some other embodiments, a plurality of separations or slots may be provided.

According to one preferred embodiment, the knuckle pin has a layered configuration with a first slot in a first layer, and a second slot in a second layer.

It is another object of the invention to provide a knuckle pin having improved construction for improving operation and force handling during coupling operations of a coupling system.

It is an object of the invention to provide an improved knuckle pin that is constructed from steel.

It is another object of the invention to provide a knuckle pin having a retaining feature that facilitates retention of the pin to a coupler to secure a knuckle on the coupler.

It is another object of the invention to produce a knuckle pin that has a retaining feature that is integral with the pin body.

It is another object of the invention to provide a retaining feature comprising tabs disposed on the end of the pin body.

It is another object of the invention to accomplish the above objects where the knuckle pin is constructed from steel.

It is another object of the invention to provide a method for producing a knuckle pin.

According to some preferred embodiments, the method for producing a knuckle pin is carried out using a blank. The blank may be produced from a sheet or roll of material, and, after stamping, is further manipulated to produce the cylindrical shape of the pin.

Embodiments of the method may include rolling the stamped blank workpiece to produce a cylindrical form workpiece that comprises the cylindrical pin. Further manipulations to the stamped blank may be carried out prior to or after the stamping. For example, the upper portion of the pin may include one or more flange or lip portions disposed in the circumferential zone of the body wall.

Some embodiments of the knuckle pin comprise a cylindrical walled body having a space therein, and a longitudinal separation between vertical ends of the longitudinal body. Preferably, the longitudinal separation extends the length of the pin body.

Some embodiments provide a plurality of separations in the wall, and provide wall segments that are separated with adjacent spaces.

According to preferred embodiments, the knuckle pins may be formed from a sheet by stamping or cutting, using a die, and rolling to provide a cylindrical or curved shape.

It is another object of the invention to provide a knuckle pin that includes a securing feature to secure the top of the pin against the coupler. According to embodiments, the securing feature contains a flange or lip, and preferably segmented portions, that extend beyond the circumferential diameter of the pin to provide a stop to prevent further lowering of the pin in the coupling aperture (e.g., such as for example, of the coupler upper lug). It is another object of the invention to accomplish the above objects where the knuckle pin is constructed from steel and includes one or more of the abovementioned features.

BRIEF DESCRIPTION OF THE DRAWING FIGURES

DETAILED DESCRIPTION OF THE INVENTION

Figure 16:
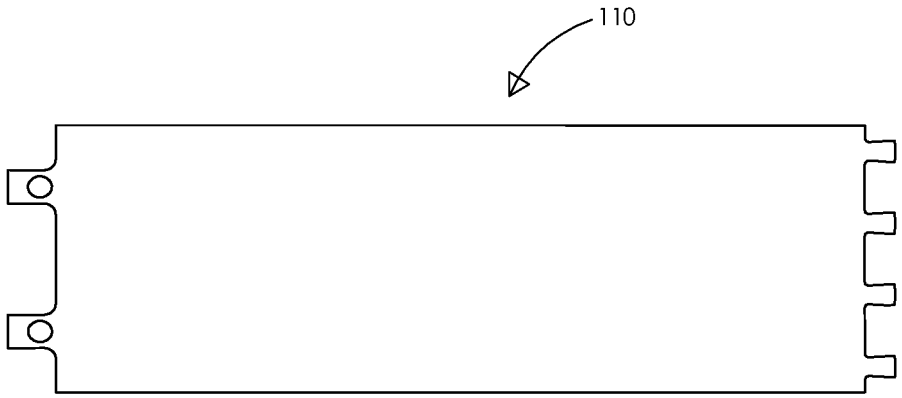
FIG. 16 is a top plan view of a workpiece that may be used to form the pin of FIG. 1.
Figure 17A:
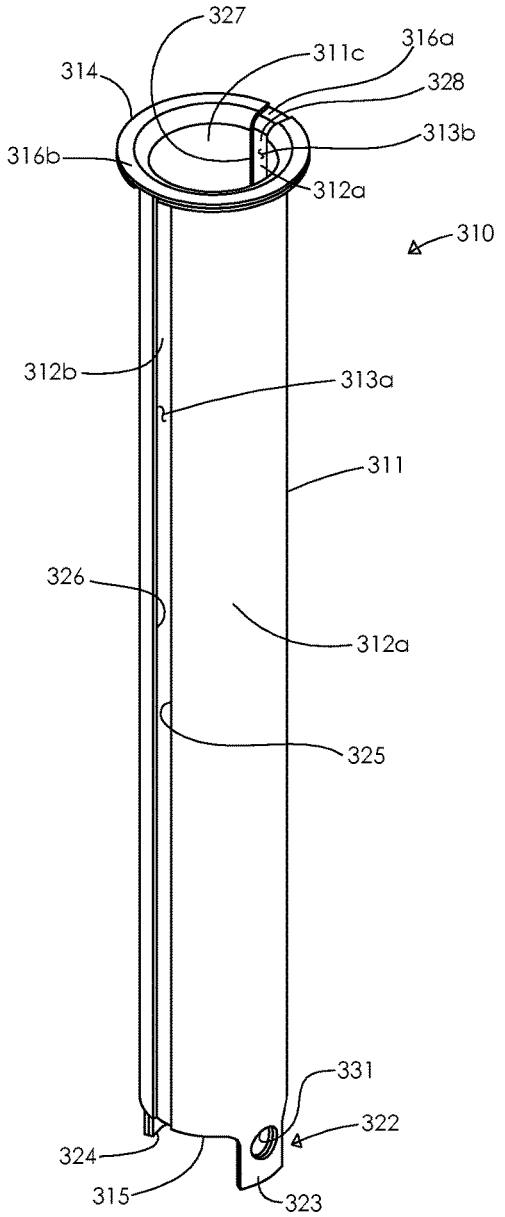
FIG. 17A is a is a perspective view of a second embodiment of a knuckle pin according to the invention.

Referring to FIGS. 1-8 there is illustrated embodiments of a knuckle pin 110 according to the invention. FIGS. 9-15 illustrate an exemplary embodiment of a coupling assembly with the pin installed to pivotally secure a knuckle on a coupler. FIG. 16 is an illustration of a workpiece that may be used to form the pin 110. FIGS. 17A-41 illustrate further embodiments of the knuckle pin.

The knuckle pin 110 preferably is constructed from metal, and, according to preferred embodiments, the pin 110 is constructed from steel. The pin 110 preferably is suitably strong and resistant to environmental temperatures and conditions. The pin is constructed with a suitable thickness and material to allow the pin body to deform during loading, and return to its position, alleviating the forces on the coupling assembly components, such as the knuckle and coupler head or lugs.

The knuckle pin 110 preferably has a cylindrical body 111 that includes a cylindrical body wall 112 with a space 113 therein. The space 113 provides a longitudinal separation between vertical ends 111*a*, 111*b* of the body 111. The longitudinal separation 113 extends the length of the pin body 111.

The pin 110 has an upper end 114 and a lower end 115. The longitudinal slot 113 is shown spanning the length of the pin body wall 112.

As depicted in the exemplary embodiment, the pin 110 is shown having a first or upper retainer 116 disposed at the upper portion 114 and extending wider than the diameter D1 of the pin body 111. According to a preferred embodiment, the upper retainer 116 is shown comprising a plurality of flanges 117, 118, 119, 120. The pin 110 is shown having a lower or second retainer 122. The lower retainer 122 is shown comprising a pair of lower legs 123, 124 protruding from the lower portion or end 115 of the pin body 111. In the embodiment illustrated, the legs 123, 124 are formed as part of the body 111.

The pin 110 is shown having a pair of opposing apertures 131, 132. The apertures 131, 132 preferably are disposed in the lower legs, respectively, 123, 124. The opposing apertures 131, 132 may receive a cotter pin or key therethrough (as shown for example in FIG. 13).

Preferably, the lower legs 123, 124 may comprise movable elements that may be moved to a retaining position to retain the pin 110 against being pulled out of the pin bore (e.g., through upward movement). For example, where the pin is used to secure a coupling assembly during a rotary dump operation, the pin 110 along with other components of the coupling assembly that it secures (such as the coupler head and knuckle), may be inverted, so that the pin 110 would have a tendency to fall out (due to gravity and/or vibrations). The movable legs 123, 124 may be moved outward (through bending), to a retaining position (as shown in the exemplary depiction in FIGS. 7, 8, 14 and 15). In order to release the pin 110, the legs 123, 124 may be moved or returned to the non-retaining position (which may be the original position or a position inward of the body diameter). Then the pin 110 may be removed by withdrawing it from the upper pivot lug of the coupler (see FIG. 15).

According to preferred embodiments, the pin 110 preferably includes both, movable elements, such as, for example, the movable legs 123, 124, and the lower apertures 131, 132, providing two options for use (e.g., one retaining using the cotter pin 300 through the apertures 131, 132 (FIG. 13), and the other retaining by bending the movable legs 123, 124 (see e.g., FIG. 14)).

Referring to FIGS. 9-15, the pin 110 is shown in use in an environment including a coupler assembly for a railway vehicle. The coupler assembly is illustrated, including a coupler head 200 and a knuckle 201. The knuckle 201 is supported by upper and lower lugs 203,204, respectively, of the coupler head 200 and is pivotally mounted to the coupler head 200 with the pin 110. The pin 110 is shown forming a vertical pivot axis of the mounted knuckle 201. Although not shown, the coupling assembly may include a lock, a thrower, and a lock lift (components traditionally used in a coupling arrangement). The pin 110 preferably is installed by aligning the knuckle pin bore 208 (see FIG. 15) with the opening or bore 210 of the coupler upper pivot lug 203 and the bore 211 of the lower pivot lug 204. The pin 110 preferably is installed in its initial configuration with the legs 123, 124 retracted or aligned with the pin body 111 so that the legs 123, 124 may pass through the coupler upper pivot lug bore 210, the knuckle pin bore 208 and the coupler lower pivot lug bore 211. When the pin 110 is lowered into the coupling assembly, the upper retainer 116, shown comprising the upper flanges 117, 118, 119, 120, may engage the coupler upper pivot lug 203, and more preferably, the pin recess portion 213 which surrounds the bore 211. When the pin 110 is installed, as shown in FIGS. 9-15, the upper flanges 117, 118, 119, 120 act as a stop to prevent further lowering of the pin 110. According to preferred embodiments, the pin 110 preferably has a suitable size and dimensions (e.g., diameter and length) to allow for use in a standard AAR coupling arrangement. However, some embodiments may be made for use with non-standard AAR sized coupling components.

Once the pin 110 is inserted through the pivot lug bore 210, the knuckle pin bore 208 and the lower pivot lug bore 211, the pin 110 preferably may be secured to prevent inadvertent lifting of the pin 110 out of the coupling assembly. This may be done by passing a cotter pin 300 through the apertures 131, 132 (see FIG. 13), or alternatively, by moving the legs 123, 124 (e.g., outward), as shown in FIG. 14.

The pin 110 provides an axis about which the knuckle 201 may pivot. This pivoting is done to open the knuckle 201 to uncouple or receive another coupling component (such as another knuckle of an adjacent rail car). During operation, the knuckle 201 may be thrown to its open position in a customary manner known in the industry, which takes place with the knuckle lock and thrower components (not shown). The coupling assembly is generally subjected to force loads, which, among other forces, include buff and draft forces. The pin 110 is suitably strong to retain the coupling components, such as, pivotally securing the knuckle 201 on the coupler 200.—During use, the pin 110 may experience forces. Movement of the coupling components, such as the coupler 200 and knuckle 201, may exert forces on the pin 110. The pin 110 is configured with a longitudinal slot 113, which allows for movements of the pin body 111 when receiving forces. The pin 110 preferably is configured to provide improved handling of force loads exerted upon it and which it received from the coupling operations, or movements of the associated rail car vehicles. The pin 110 may absorb and/or deflect the force loads. Preferably, the pin 110 is constructed from a suitable metal, preferably steel, and having a suitable thickness, so that upon receiving a load that deflects or moves the pin 110 or portion thereof, the pin body 111 may return to its initial position or condition. For example, one or more portions of the pin body 111 may move in a manner that causes one, or both edges 111*a*, 111*b* to move closer to one another, or move inward into the interior space 111*c* of the pin 110. The movement preferably may be a deflection, allowing the pin body portion to return to its original or prior position or condition.

Pins according to the invention, such as the pin 110 shown and described herein, may be produced using a suitable method. According to a preferred production process, the pin 110 is produced from a sheet of material and is stamped and manipulated to form the circumferential body with the retaining features. According to a preferred implementation, the method of production involves providing a blank, which may be a piece of material, preferably metal, such as steel. The blank may be part of a roll, or sheet. The blank, which may be part of a sheet already cut, or part of a roll or larger sheet (for multiple blanks) that is cut during the process, is stamped with the pattern, preferably the pattern of the workpiece form that is used to produce the pin 110. As shown in FIG. 16, the pin 110 may be formed from a sheet, where a die is used (e.g., by stamping or pressing), to cut the form of the workpiece 110', represented by FIG. 16. The workpiece may be cut, and then rolled to form the pin 110, or alternatively, the workpiece rolled, and then cuts made to complete the pin formation.

The pin 110 provides an axis about which the knuckle 201 may pivot. This pivoting is done to open the knuckle to uncouple or receive another coupling component (such as another knuckle of an adjacent rail car). During operation, the knuckle 201 may be thrown to its open position in a customary manner known in the industry, which takes place with the knuckle lock and thrower components (not shown). The coupling assembly is generally subjected to force loads, which, among other forces, include buff and draft forces. The pin 110 is suitably strong to retain the coupling components, such as, pivotally securing the knuckle 201 on the coupler 200, and more particularly the coupler head.

An alternate embodiment of a knuckle pin 310 is shown in FIGS. 17A-19. The knuckle pin 310 is shown having The knuckle pin 310 preferably has a cylindrical body 311 comprising a first portion with an outer wall 312*a* and a second portion with an inner wall 312*b*. A outer wall space 313*a* is provided in the outer wall 312*a*, and an inner wall space 313*b* is provided in the inner wall 312*b*. The outer wall space 313*a* provides a longitudinal separation between respective vertical ends 325, 326 of the outer wall 312*a*, and the inner wall space 313*b* provides a longitudinal separation between respective vertical ends 327, 328 of the inner wall 312*b*.

The longitudinal separations 313*a*, 313*b* are shown according to a preferred embodiment extending the length of the pin body 311. The pin 310 has an upper end 314 and a lower end 315. In the illustrated exemplary embodiment, each longitudinal slot 313*a*, 313*b* is shown spanning the length of the respective pin body walls 312*a*, 312*b*.

Figure 18:
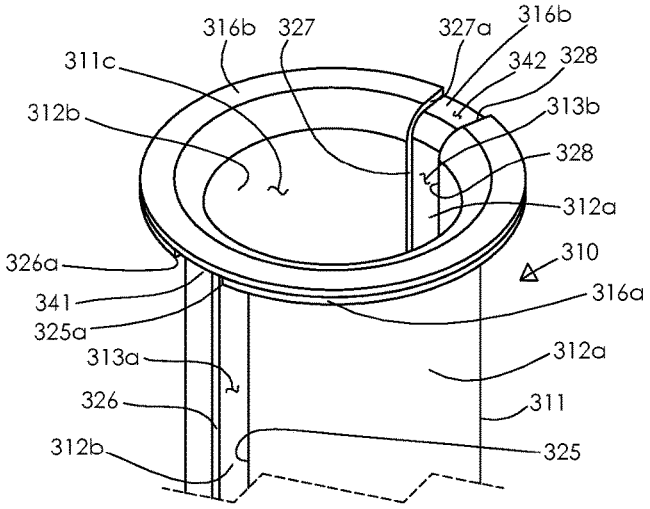
FIG. 18 is an enlarged perspective partial view of the top portion of the knuckle pin of FIG. 17A, as viewed from the top left looking downward.
Figure 17B:
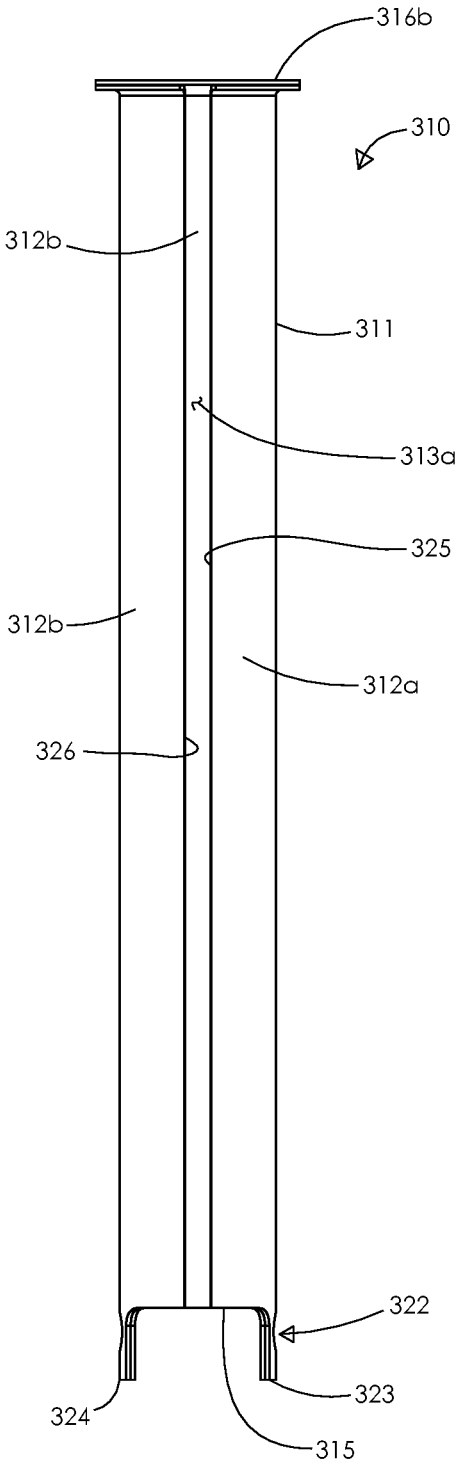
FIGS. 17B through 17E are additional views of the pin from different sides.
Figure 17C:
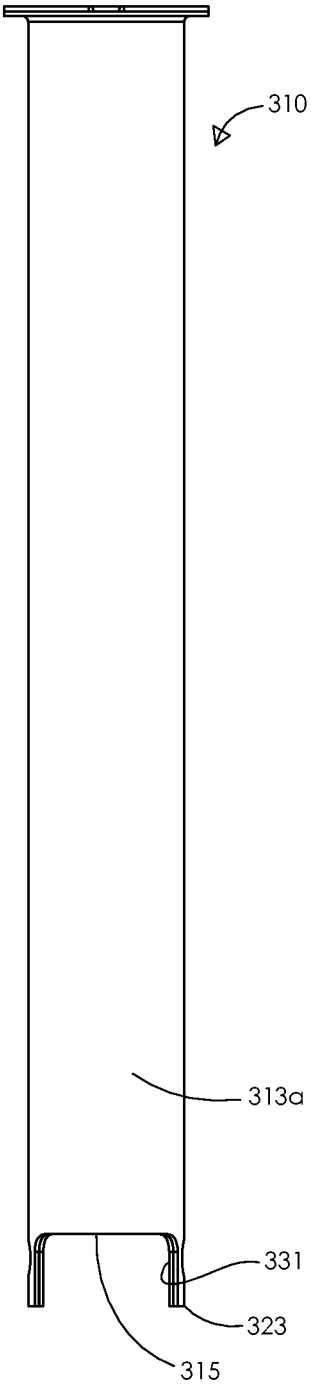
Figure 17D:
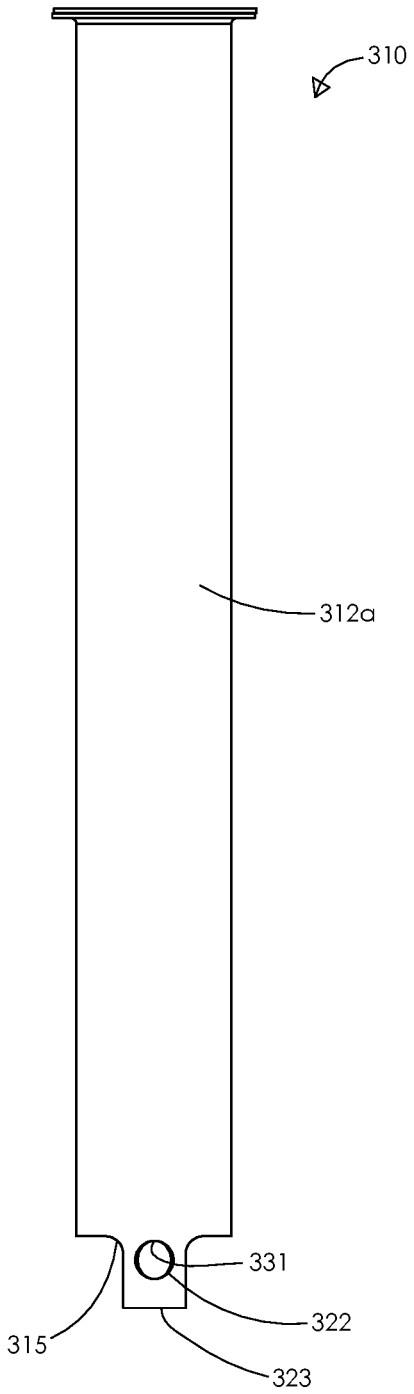
Figure 17E:
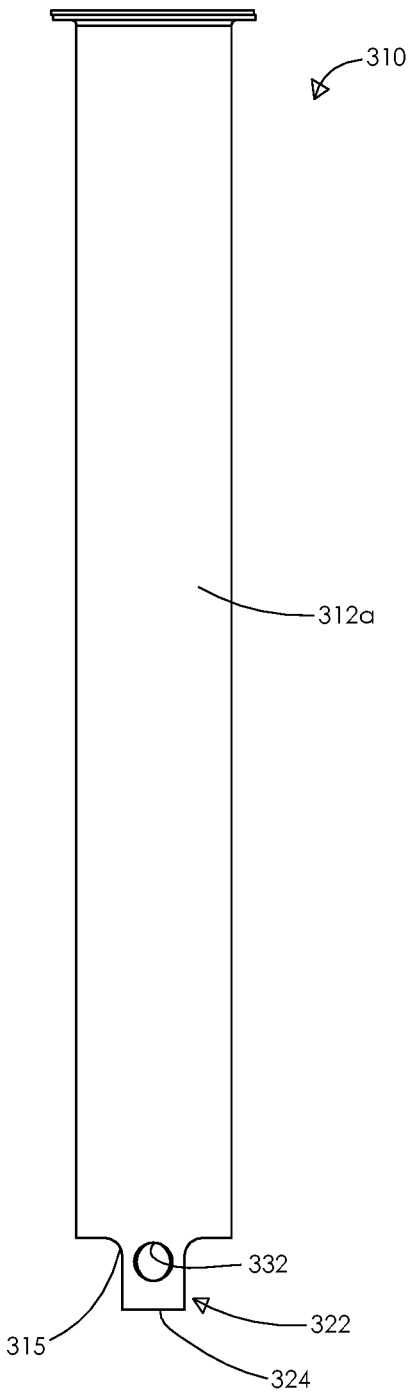
Figure 19:
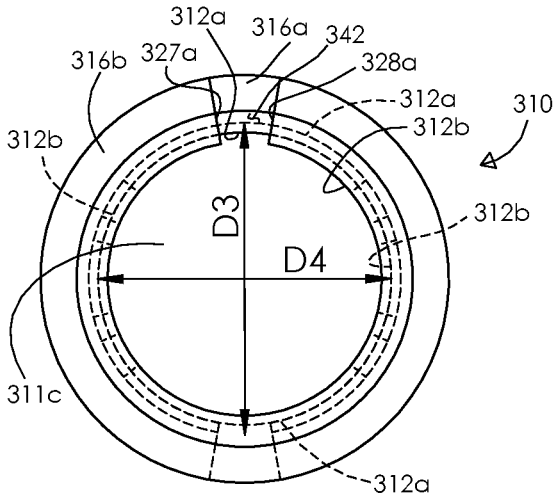
FIG. 19 is a top plan view of the knuckle pin of FIG. 17A.

As depicted in the exemplary embodiment, the pin 310 is shown having a first or upper retainer 316*b* of the inner wall 312*b* disposed at the upper portion 314 and extending wider than the diameter D3 of the pin body 311, and preferably wider than the outer surface of the outer wall 312*a* (see FIG. 19). The pin 310 also is shown having a second or lower retainer 316*a*, which according to a preferred configuration is shown extending wider than the diameter D4 of the inner wall 312*b*. In the exemplary embodiment depicted, the vertical ends or edge portions 327, 328 of the wall 312*b* are shown turning from their vertical orientation to form a flange opening 342, shown between the wall edges 327*a*, 328*a* (FIG. 19). Referring to FIG. 18, a flange opening 341 is shown in the second or lower flange 316*a*. The vertical ends or edge portions 325, 326 of the wall 312*a* are shown turning from their vertical orientation to form a flange opening 341 between the wall edges 325*a*, 326*a*.

According to preferred embodiments, the body 311 may comprise two separate portions, comprising the first portion with the outer wall 312*a*, and second portion with the inner wall 312*b*. The second portion or inner wall 312*b* is shown received within the body space of the first portion 312*a*. According to a preferred embodiment, the flanges 316*a*, 316*b* may nest on each other.

The vertical slots 313*a*, 313*b* in the respective walls 312*a*, 312*b* are shown aligned in opposing positions (see FIG. 18). The pin 310 provides two vertical accommodations via the slots 313*a*, 313*b* for handling forces that are imparted on the pin 310. The pin walls 312*a*, 312*b*, as well as the flanges, may be deflected by the forces to alleviate stresses that otherwise could break or compromise the pin or coupling components with which it operates.

According to a preferred embodiment, the first or upper retainer 316*a* is shown forming a continuous flange configuration, and the second or lower retainer 316*b* is shown forming a continuous flange configuration, with the separations aligned with the respective vertical slot 313*a*, 313*b*. However, although not shown, flanges may be formed from a plurality of flange portions, such as the plurality of flanges 117, 118, 119, 120 shown in the embodiment of FIG. 1.

The pin 310 preferably also includes a lower retainer which may be similar to the lower retainer 122 shown in FIGS. 1-15 in connection with the pin 110. Referring to FIGS. 17A-17E, the pin 310 is shown having a lower or second retainer 322. The lower retainer 322 is shown with lower legs 323, 324 protruding from the lower portion or end 315 of the pin body 311. In the embodiment illustrated, the legs 323, 324 are formed as part of the body first portion or first wall 312*a*. Similar to what is shown in the pin 110, a pair of opposing apertures 331 (and another on the leg 324, now shown) may be provided. The apertures preferably are disposed in the lower legs, respectively, 323, 324. The opposing apertures 331 (and the other leg aperture in the leg 324) may receive a cotter pin or key therethrough (as shown for example in the embodiment of FIG. 13).

Preferably, the lower legs 323, 324 may comprise movable elements that may be moved to a retaining position to retain the pin 310 against being pulled out of the pin bore (e.g., through upward movement). For example, where the pin is used to secure a coupling assembly during a rotary dump operation, the pin 310 along with other components of the coupling assembly that it secures (such as the coupler head and knuckle), may be inverted, so that the pin 310 would have a tendency to fall out (due to gravity and/or vibrations). The movable legs 323, 324 may be moved outward (through bending), to a retaining position (as shown with the pion 110 in FIGS. 7, 8, 14 and 15). In order to release the pin 310, the legs 323, 324 may be moved or returned to the non-retaining position (which may be the original position or a position inward of the body diameter). Then the pin 310 may be removed by withdrawing it from the upper pivot lug of the coupler (see the pin 110 in reference to FIG. 15).

Figure 1:
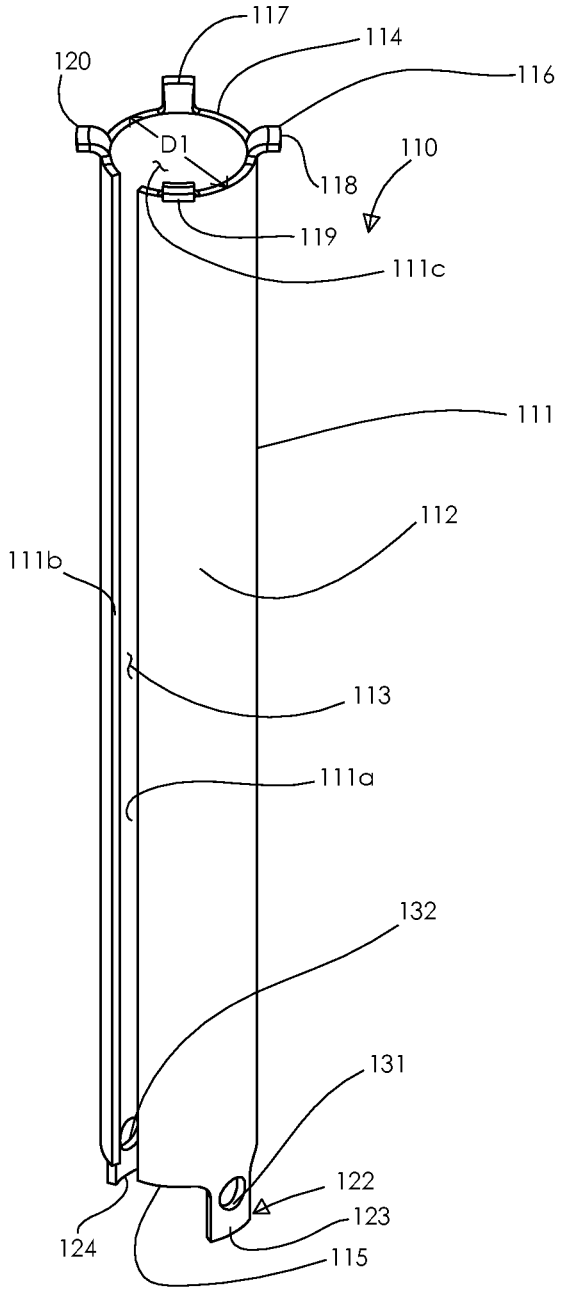
FIG. 1 is a perspective view of a first embodiment of a knuckle pin according to the invention.
Figure 2:
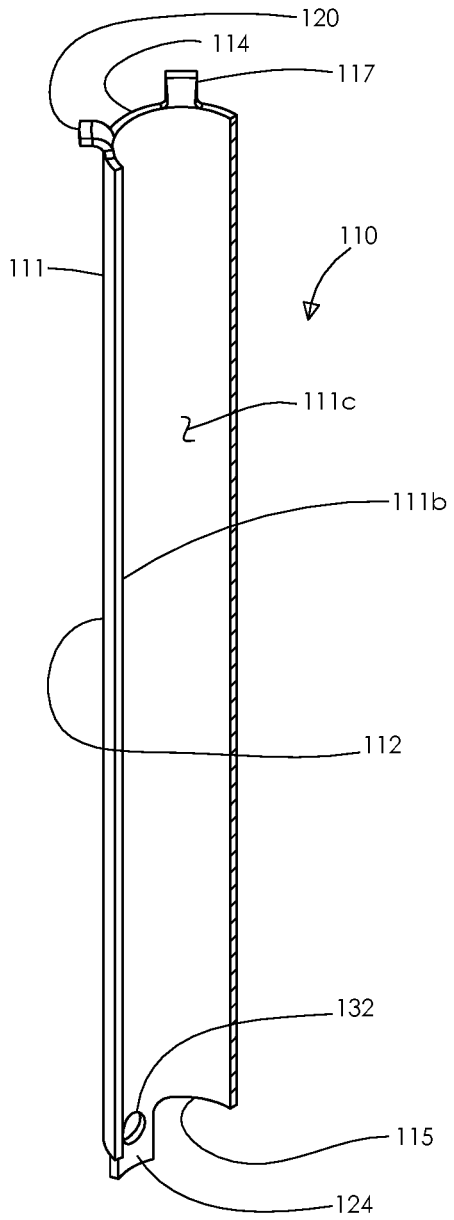
FIG. 2 is a front sectional view of the pin of FIG. 1.
Figure 3:
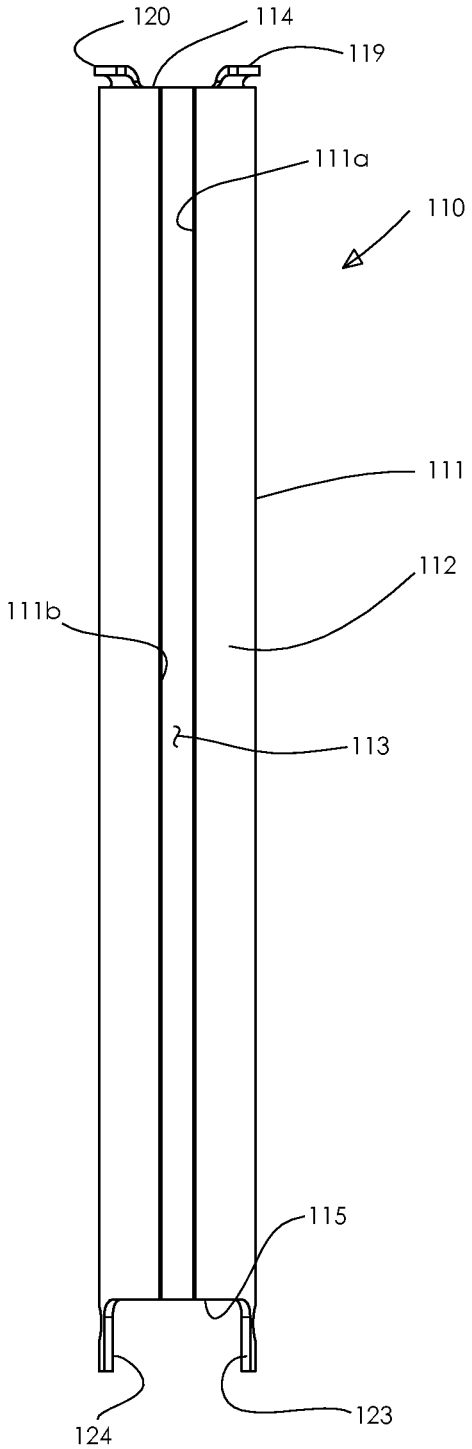
FIG. 3 is a front elevation view of the knuckle pin of FIG. 1.
Figure 4:
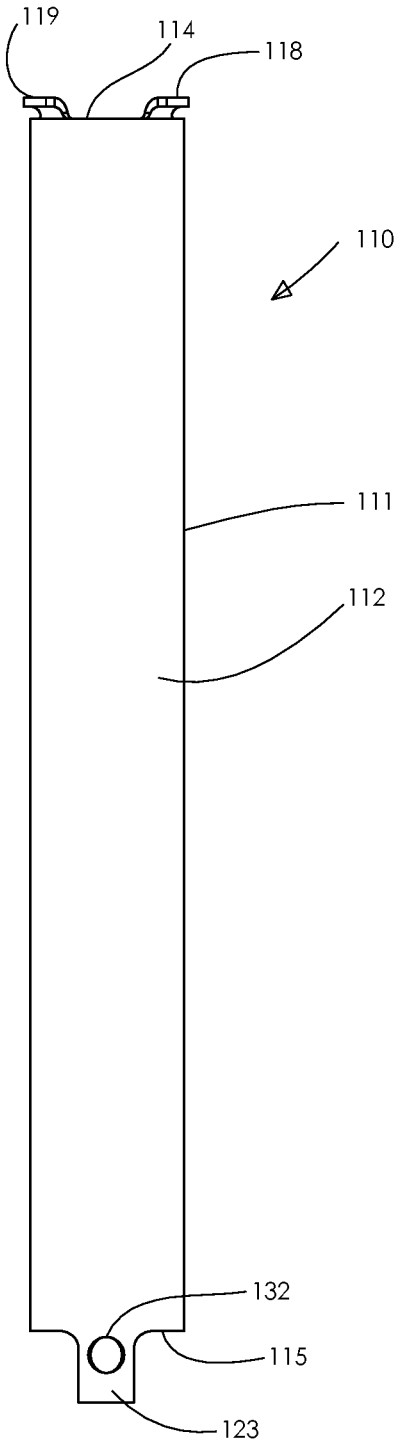
FIG. 4 is a right side elevation view of the knuckle pin of FIG. 1.
Figure 5:
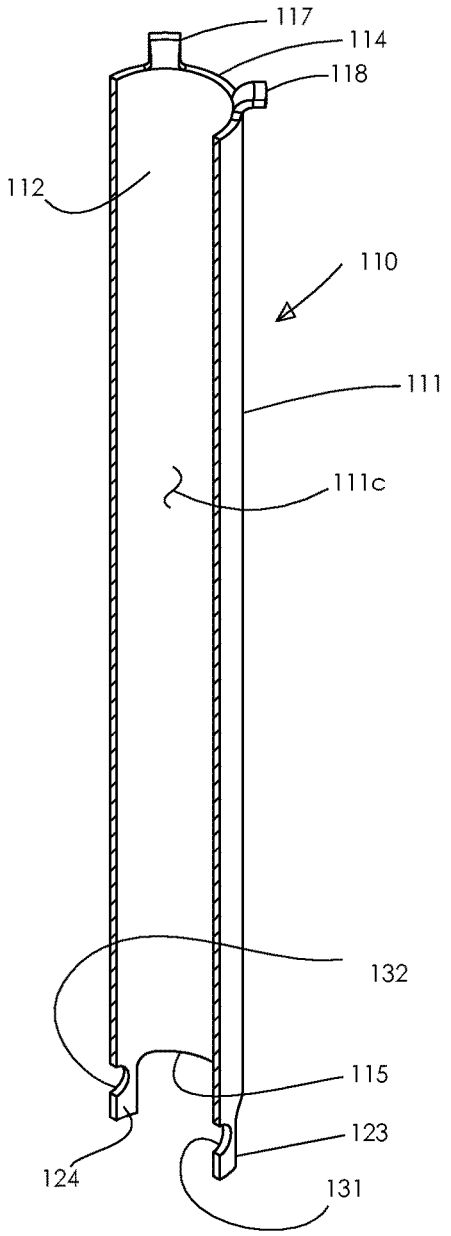
FIG. 5 is a right sectional view of the knuckle pin of FIG. 1.
Figure 6:
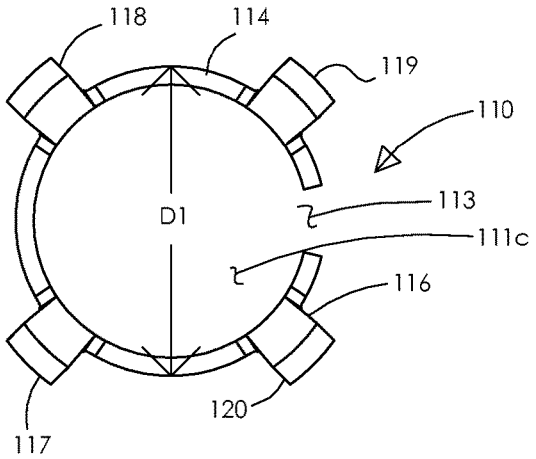
FIG. 6 is a top plan view of the knuckle pin of FIG. 1.
Figure 7:
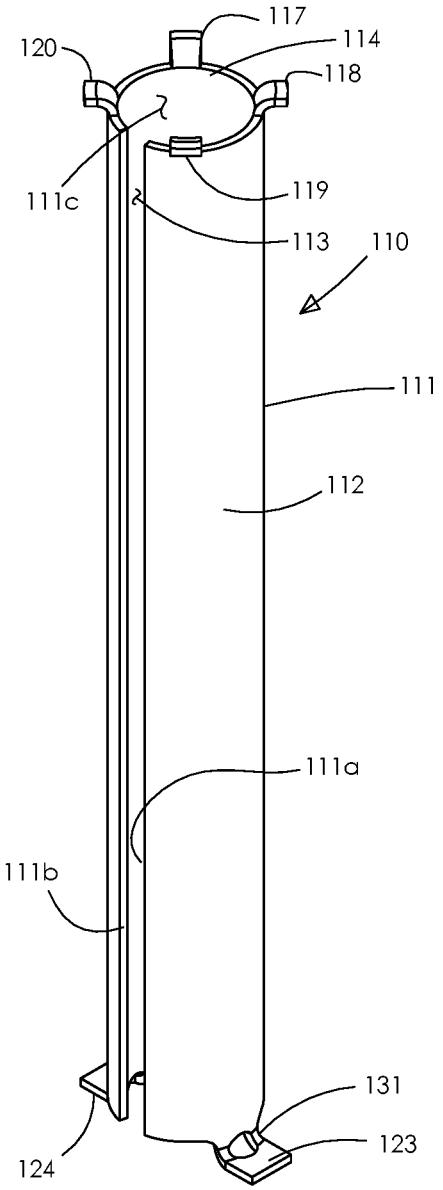
FIG. 7 is a perspective view of the knuckle pin of FIG. 1, shown with the legs being bent outwardly.
Figure 8:
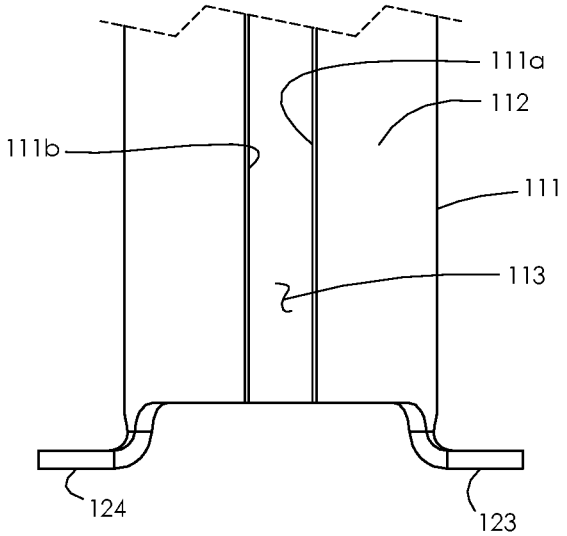
FIG. 8 is an enlarged view showing a portion of the pin of FIG. 1, in the configuration represented by FIG. 4, with the legs outwardly bent.
Figure 9:
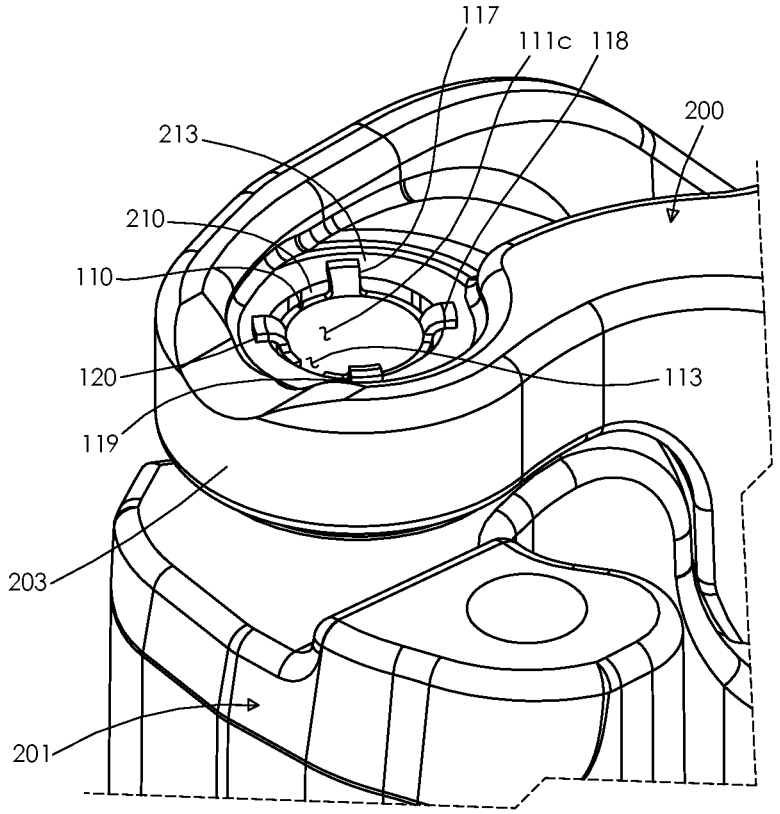
FIG. 9 is a coupling assembly shown in partial view, with a knuckle pivotally mounted on a coupler with the knuckle pin of FIG. 1.
Figure 10:
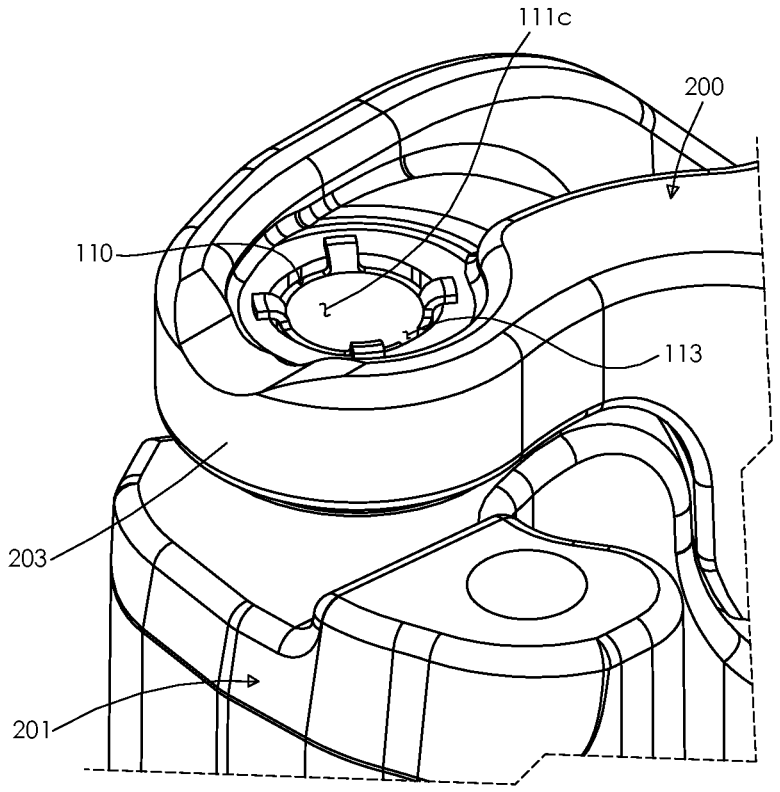
FIGS. 10-12 show the coupling assembly of FIG. 9, but with the pin shown in different locations.
Figure 11:
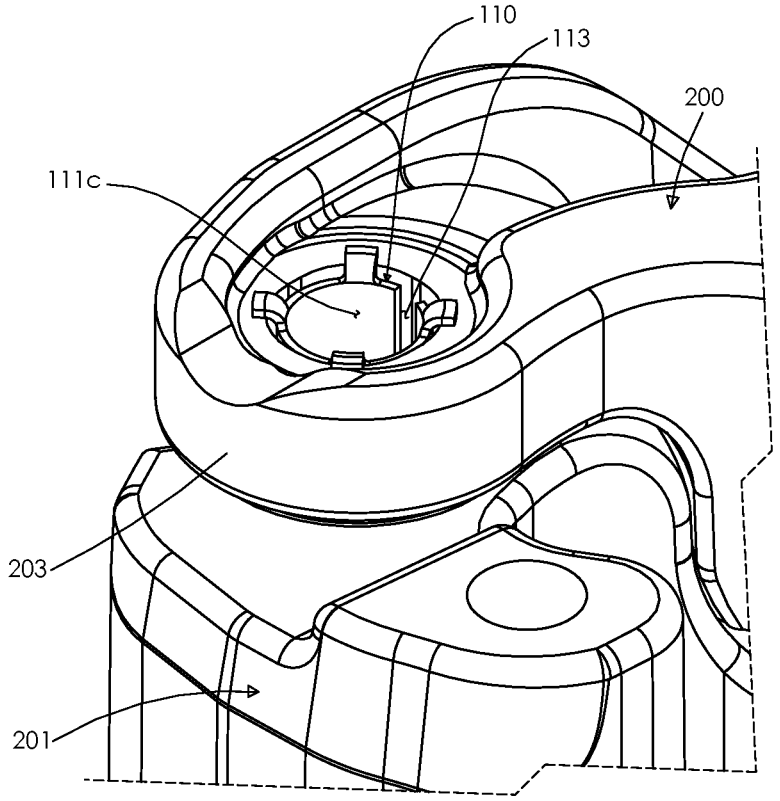
Figure 12:
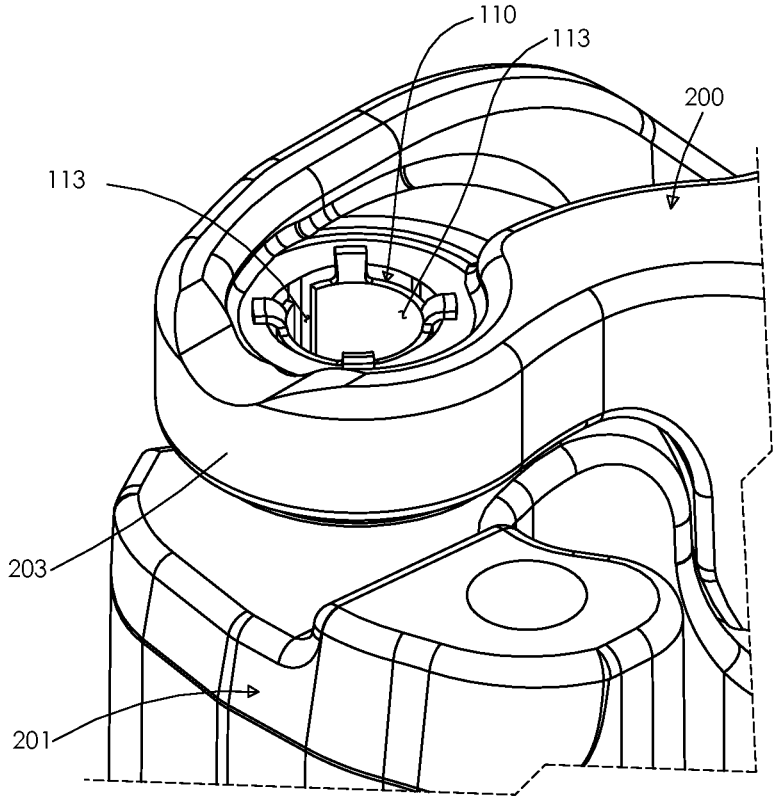
Figure 13:
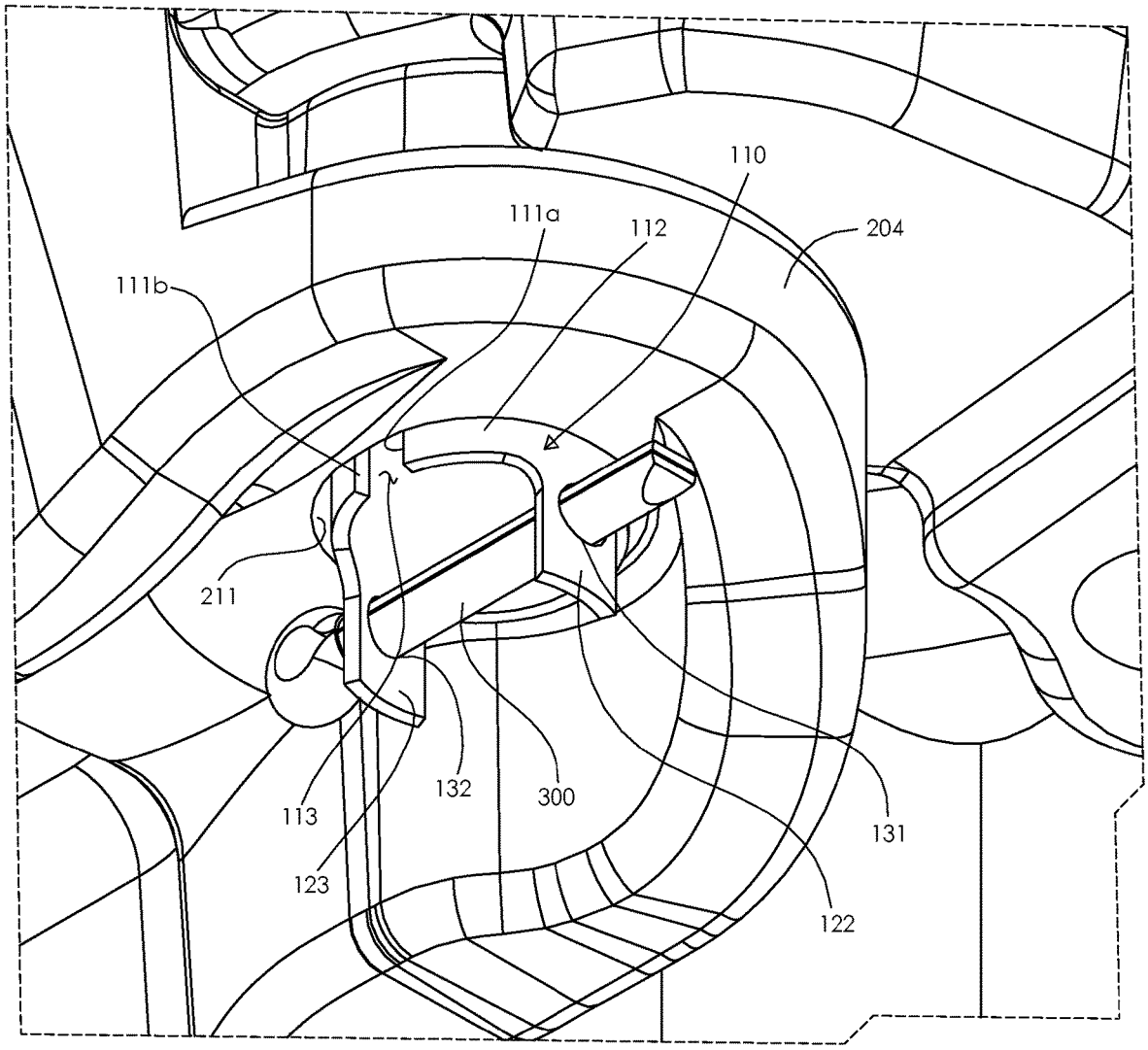
FIG. 13 is a perspective view looking from the bottom of the coupling assembly of FIG. 9, showing a first implementation where a cotter key or pin secures the pin.
Figure 14:
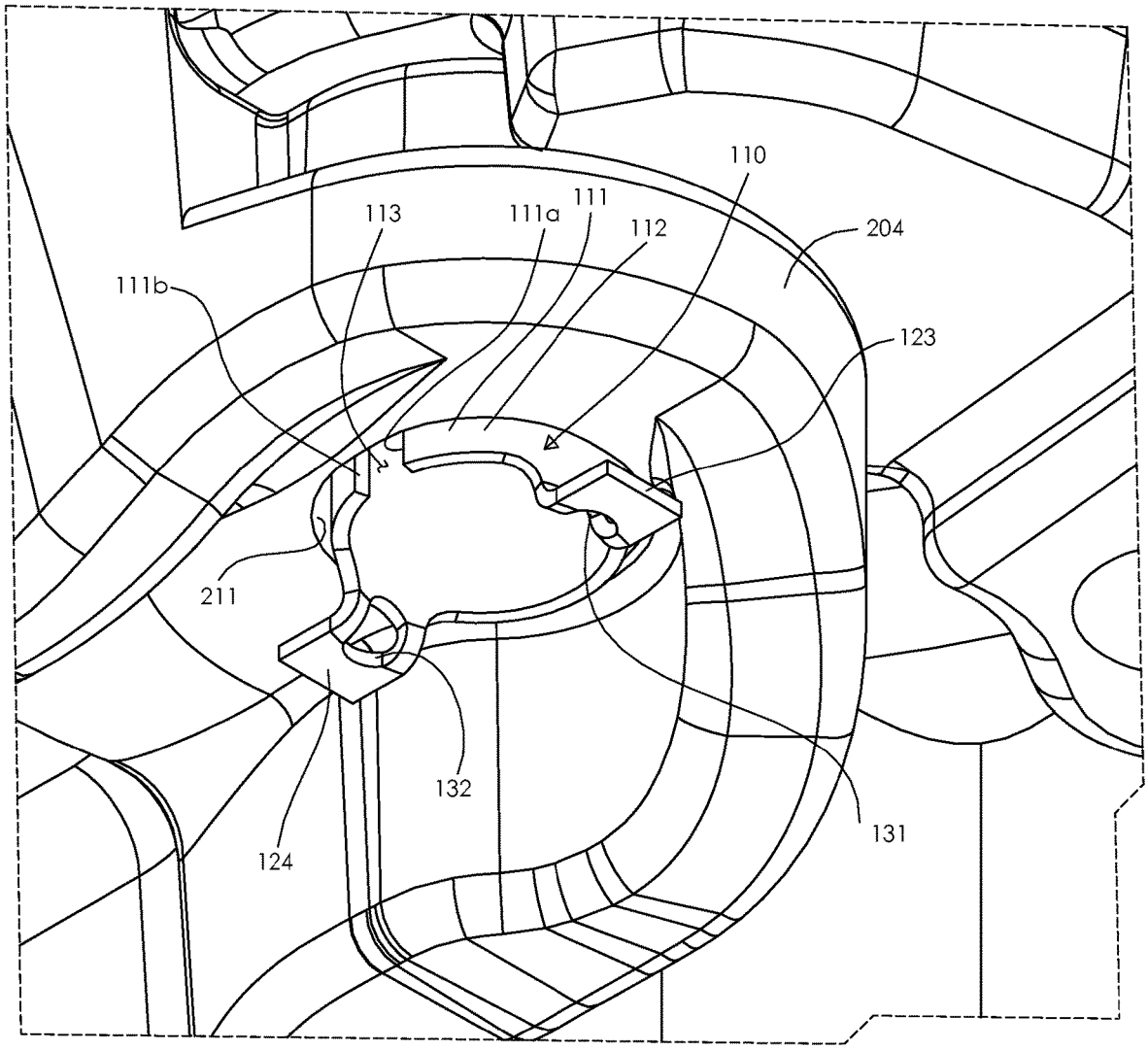
FIG. 14 is a perspective view looking from the bottom of the coupling assembly of FIG. 9, showing a second implementation where the legs are bent outwardly to secure the pin.
Figure 15:
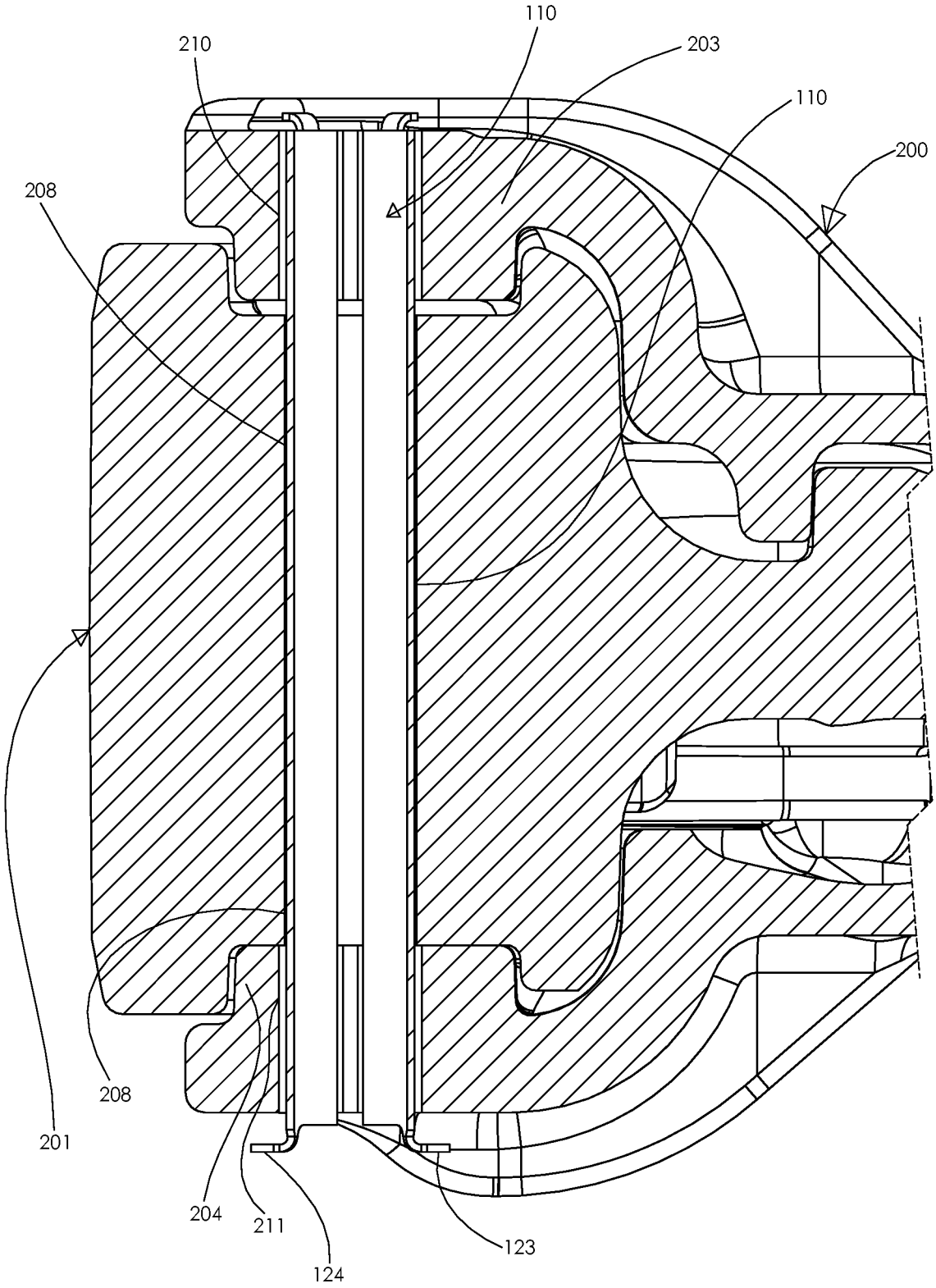
FIG. 15 is a view of the coupling assembly of FIG. 9, shown with the coupler and knuckle in sectional views, with the pin of FIG. 1 pivotally mounting the knuckle on the coupler.

According to preferred embodiments, the pin 310 preferably includes both, movable elements, such as, for example, the movable legs 323, 324, and the lower apertures 331 (and another aperture of leg 324), providing two options for use (e.g., one for retaining using a cotter pin (such as with the pin 300 shown through the apertures 131, 132 in the pin 110 of FIG. 13), and the other retaining by bending the movable legs 323, 324 (such as like the movable legs 123, 124 of the pin 110 shown in FIG. 14).

According to alternate embodiments, the legs 323, 324 may be formed on the other wall, such as at the lower end of the second portion or inner wall 312*b*, or ion yet other embodiments, may be provided on both the first portion and the second portion, e.g., on 312*a* and 312*b*. According to a preferred embodiment the legs are provided on each wall 312*a*, 312*b* and align with each other so that the apertures 331, 332 formed in each leg 323, 324 align with each other (such that the legs of the inner wall 312*b* match up with the legs of the outer wall 312*a*, and the respective apertures align. Similar to what is shown in the pin 110, a pair of opposing apertures 331, 332 may be provided. The apertures preferably are disposed in the lower legs, respectively, 323, 324. The opposing apertures 331, 332 may receive a cotter pin or key therethrough (as shown for example in the embodiment of FIG. 13). In embodiments where the legs align (e.g., such as the inner wall legs and outer wall legs), preferably one opposing pair of legs or both may be bent upward to provide the retaining function.

Figure 20:
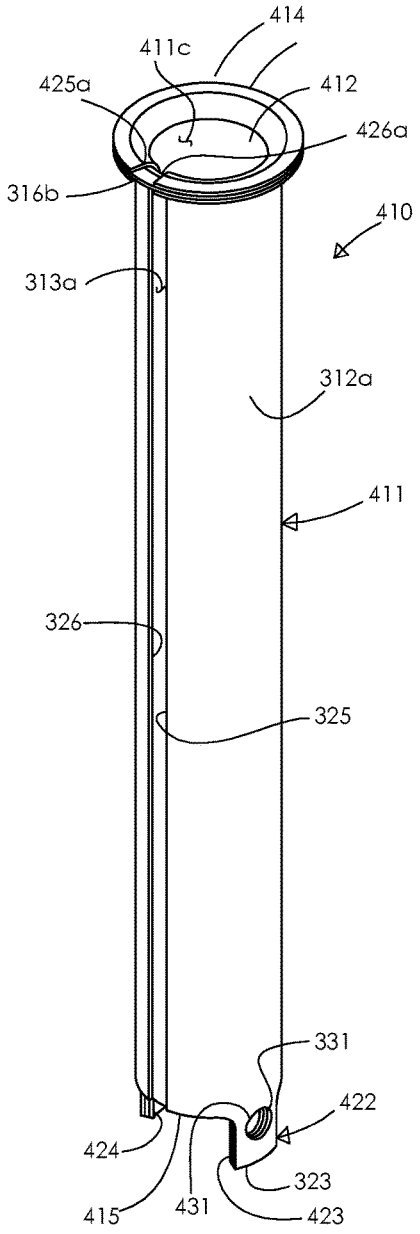
FIG. 20 is a is a perspective view of a third embodiment of a knuckle pin according to the invention.
Figure 21:
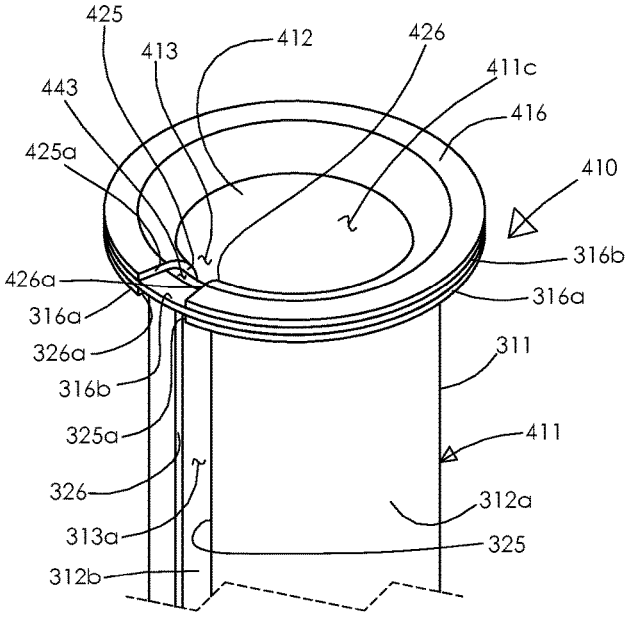
FIG. 21 is an enlarged perspective partial view of the top portion of the knuckle pin of FIG. 20, as viewed from the top left looking downward.
Figure 22A:
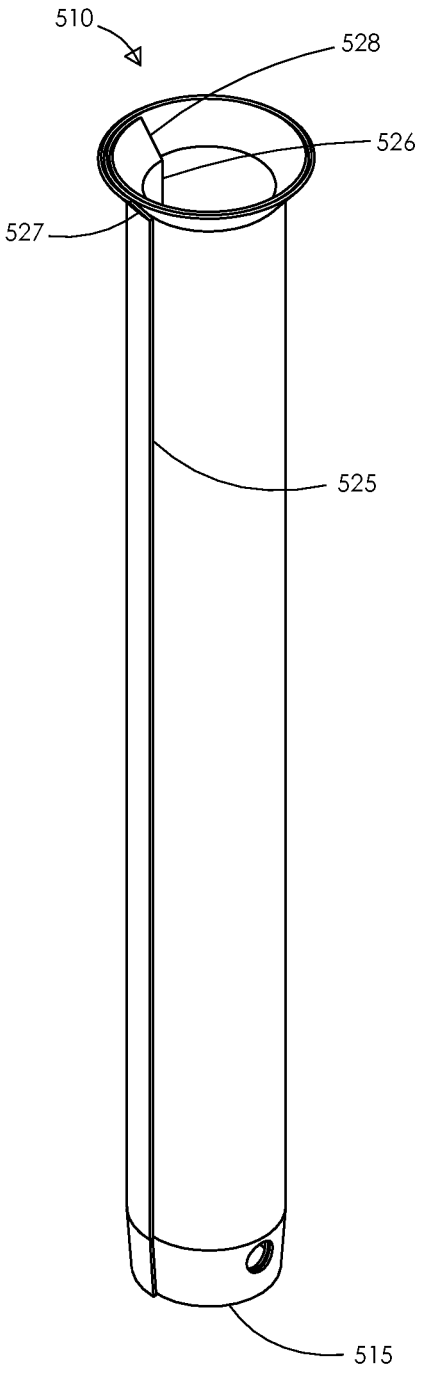
FIG. 22A is a is a perspective view of a fourth embodiment of a knuckle pin according to the invention.
Figure 22B:
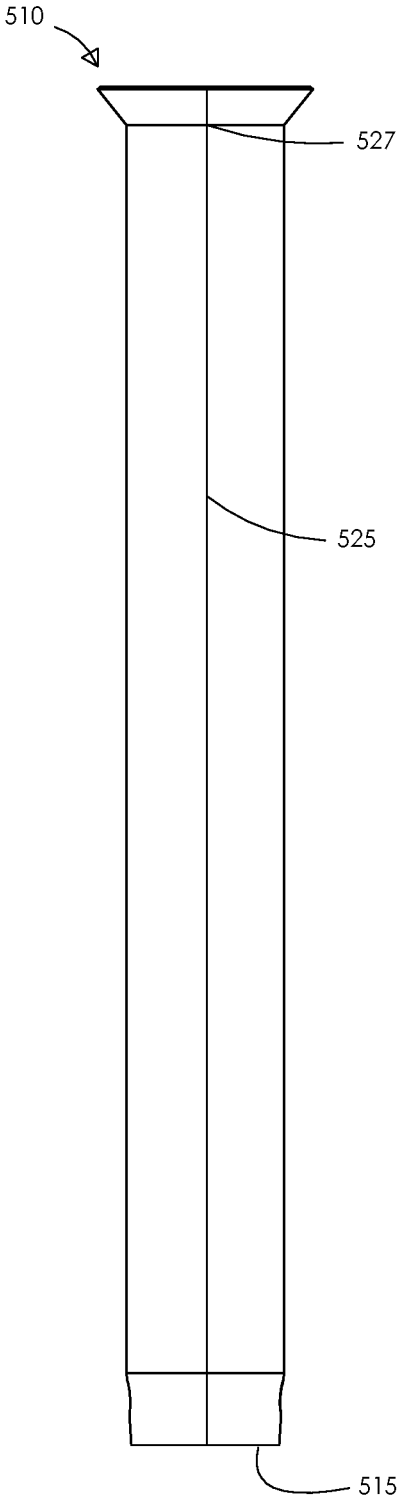
FIGS. 22B through 22E are additional views of the pin from different sides.
Figure 22C:
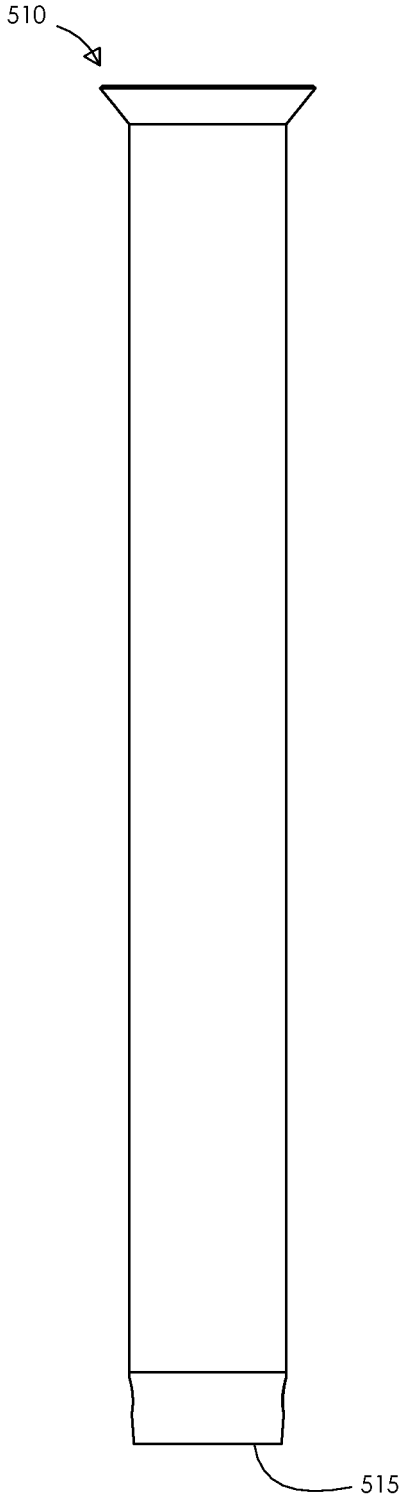
Figure 22D:
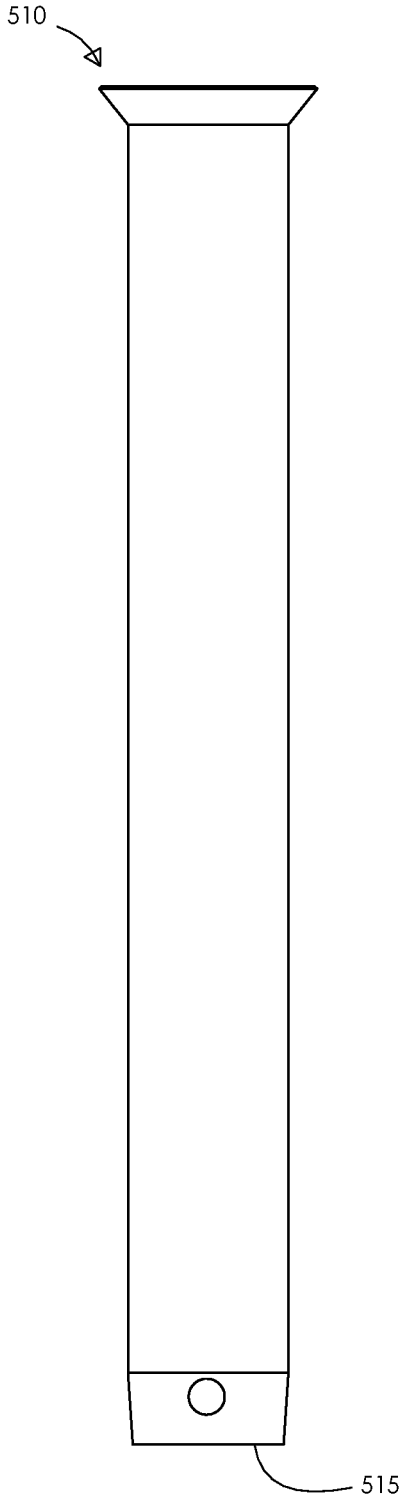
Figure 22E:
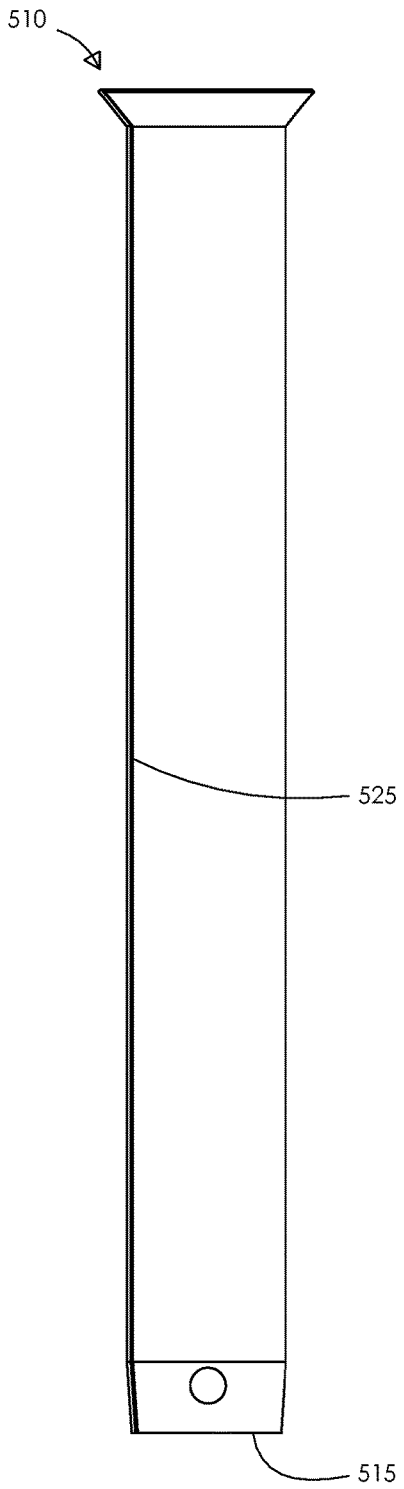

Referring to FIGS. 20 and 21, a further alternate embodiment of a pin 410 is shown having a configuration that is similar to the pin 310 shown in FIGS. 17A-19, but having a body 411 that is comprised of three portions, including the first portion 312*a* and second portion 312*b* of the pin 310 shown in FIGS. 17A-19, and with a third portion shown comprising the inner wall 412. The third portion 412 preferably inserts within the second portion or wall 312*b*. According to preferred embodiments, the flanges 316*a*, 316*b* and 416 may nest on each other. In the embodiment illustrated, the third portion wall 412 has a vertical opening that is shown aligned with the vertical opening 313*a* of the first or outer wall 312*a*. The knuckle pin 410 preferably has a cylindrical body 311 comprising a first portion with an outer wall 312*a*, a second portion with an inner wall 312*b*, and a third portion with another inner wall 412 that is configured to be received within the second inner wall 312*b*. The third portion inner wall 412 has a longitudinal separation between respective vertical ends 425, 426 of the wall 412. A flange opening 443 is shown in the third flange 416. The vertical ends or edge portions 425, 426 of the wall 412 are shown turning from their vertical orientation to form a flange opening 443 between the wall edges 425*a*, 426*a*.

Similar to the pins 110 and 310 shown and described herein, the pin 410 may include retaining means at the lower portion. Referring to FIG. 21, the pin 410 is shown having a lower or second retainer 422. The lower retainer 422 is shown having lower legs which include the legs 323, 324 shown in FIGS. 17A-17E, and the legs 423, 424 protruding from the lower portion or end 415 of the pin body 411. In the embodiment illustrated, the legs 423, 424 are formed as part of the body third portion or third wall 412, and comprise the legs 323, 324 of the wall 312*a* (FIGS. 17A-17E). In the embodiment of the pin 410 shown, the legs 423, 424 are depicted comprised of a stack of the legs formed at the ends of walls 312*a*, 312*b* and 412. The inner leg 423, 424 are shown underlying the legs 323, 324. Apertures are provided in the leg portions, and including in the leg portions 423, 424. Similar to what is shown in the pin 110, a pair of opposing apertures 431 (and another on the leg 424, not shown) may be provided to receive a cotter pin or key therethrough (as shown for example in the embodiment of FIG. 13). As discussed herein, the lower retainer may comprise legs provided on one or more of the wall portions, and as shown in the preferred embodiments, may be provided on each wall portion. According to some implementations, a single opposing leg paid may be bent upwardly for retention, while the other legs remain in their vertical position. Alternatively, a pin may be installed, with each of the legs remaining in the unbent or vertical position. Other embodiments may be provided with a single pair of legs on at least one of the walls forming the pin.

Figure 23A:
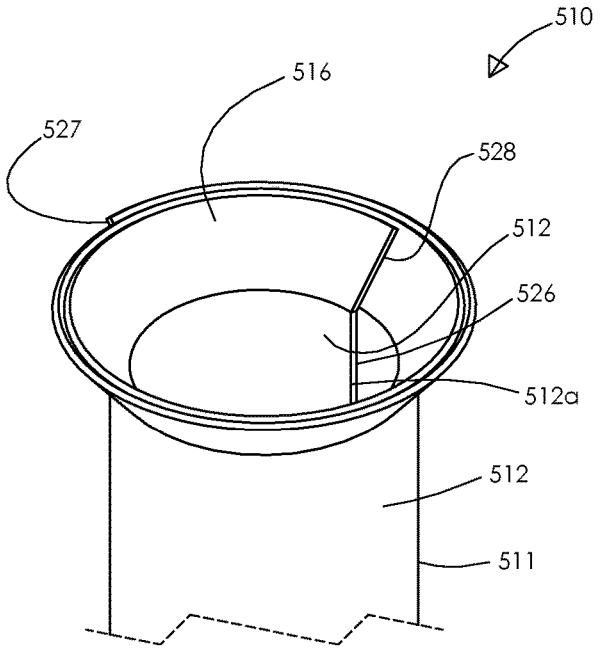
FIG. 23A is an enlarged perspective partial view of the top portion of the knuckle pin of FIG. 22A, as viewed from the top left looking downward.
Figure 23B:
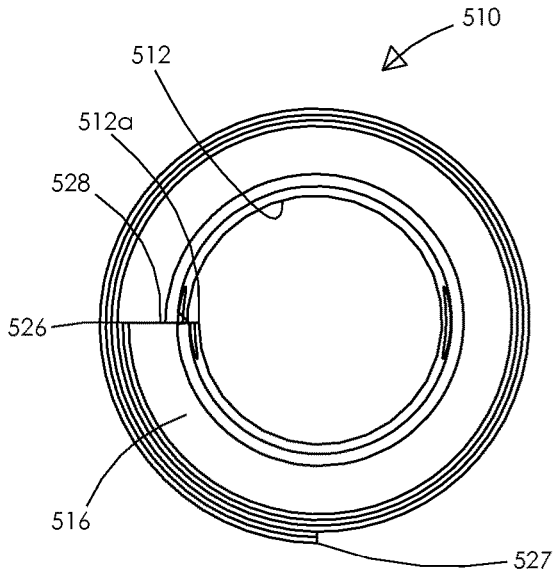
FIG. 23B is a top plan view.
Figure 23C:
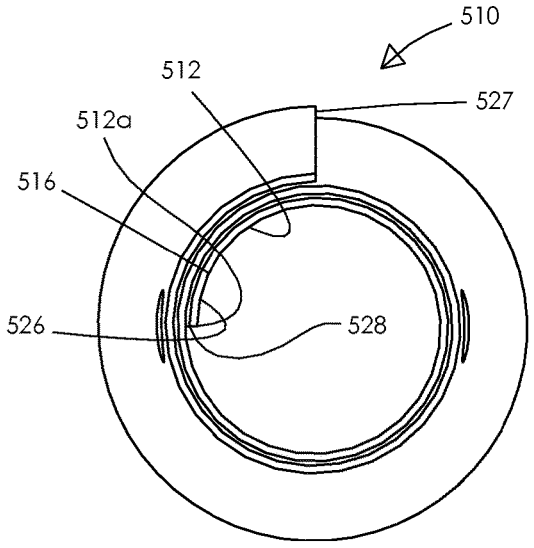
FIG. 23C is a bottom plan view.
Figure 24A:
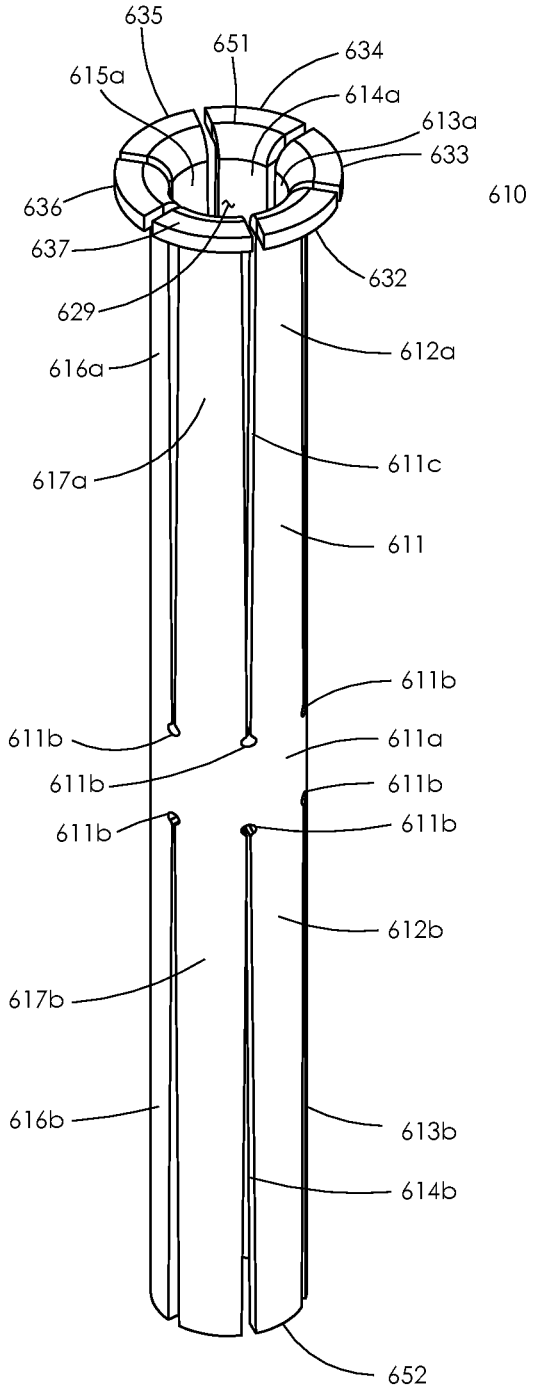
FIG. 24A is a is a perspective view of a fifth embodiment of a knuckle pin according to the invention.
Figure 24B:
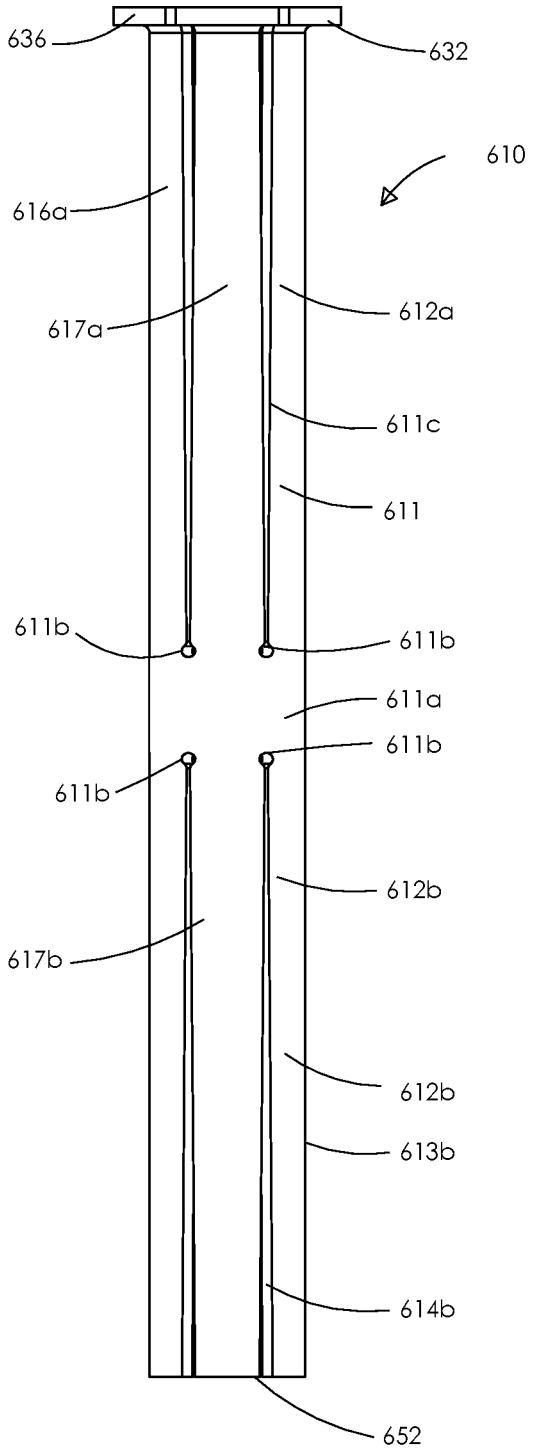
FIGS. 24B-24E are additional views of the pin from different sides.
Figure 24C:
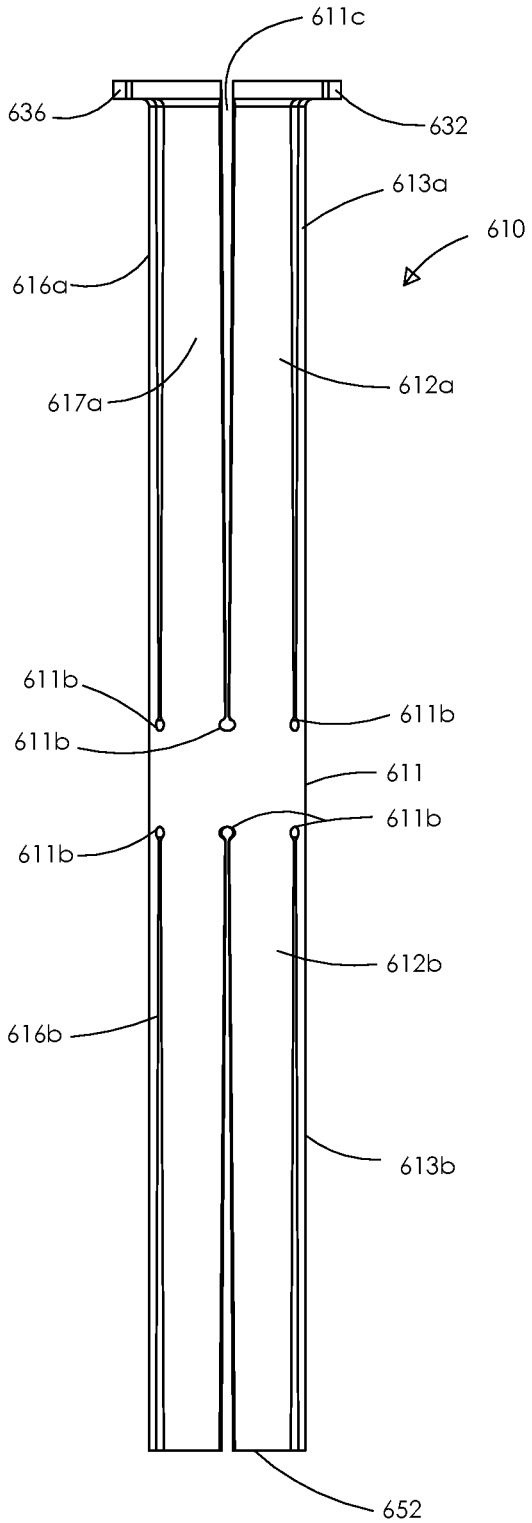
Figure 24D:
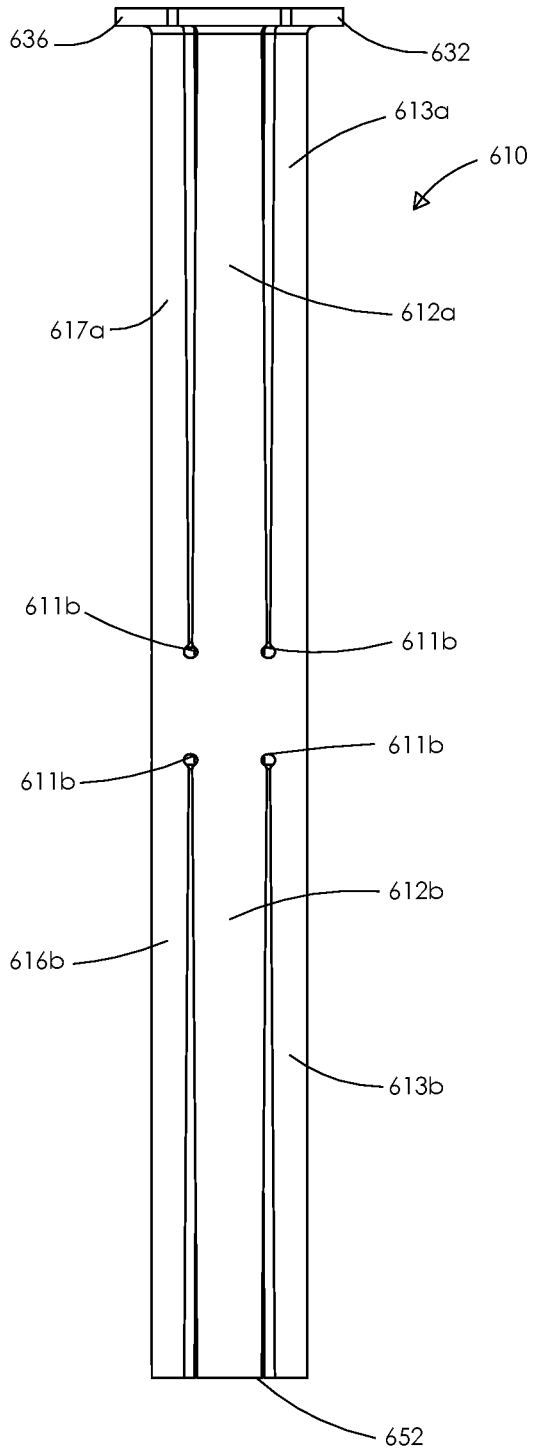
Figure 24E:
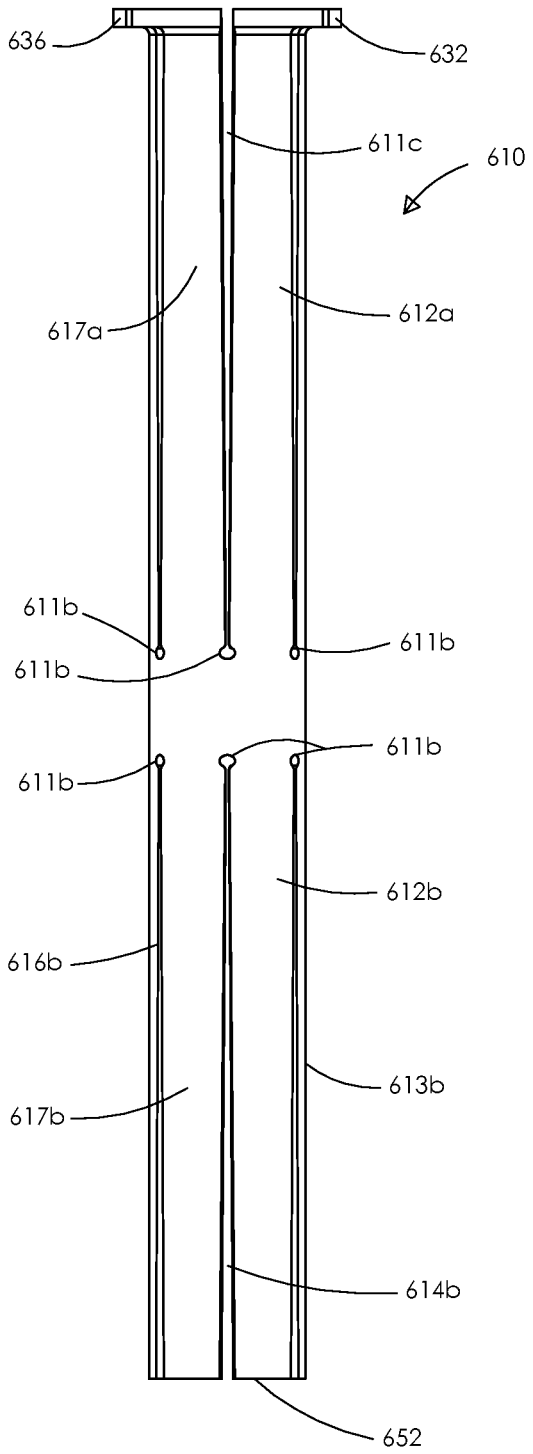
Figure 25A:
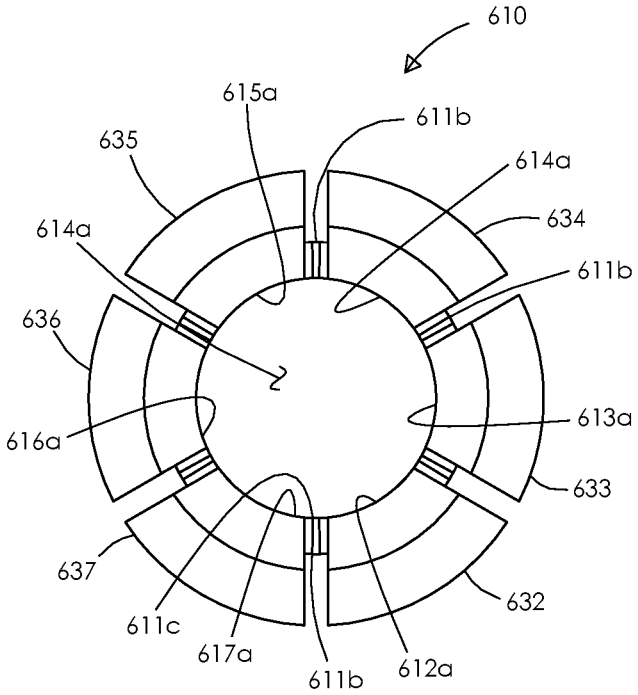
FIG. 25A is a top plan view of the knuckle pin of FIG. 24A.
Figure 25B:
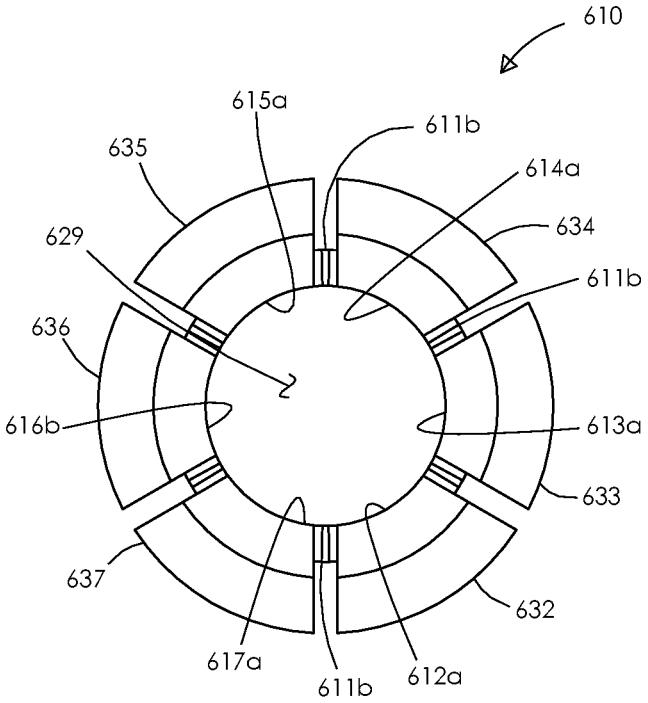
FIG. 25B is a bottom plan view.

Referring to FIGS. 22 and 23, an alternate embodiment of a knuckle pin 510 is shown comprising a body 511 having a wall 512 that preferably is cylindrical or curved, and overlaps itself. According to preferred embodiments, the wall 512 preferably is concentric and may with an increasing or decreasing radius as the wall 512 turns to overlap itself. An upper flange portion 516 is shown and has a span that is wider than the cylindrical or curved body wall 512. The upper flange 516 is shown according to a preferred embodiment as an extension of the wall 512. In the embodiment illustrated, the wall 512 and flange 516 comprise at least one section or portion where there are two overlaps of the wall 512 and flange, and at least one other section where there are three overlaps of the wall 512 and flange. According to preferred embodiments, the wall 512 makes at least one overlap with itself. According to some embodiments, where the wall 512 makes at least one overlap with itself, flange 516 comprising an extension of the wall 512 also makes at least one overlap with itself. The wall 512 has a thickness 512*a* and an first edge or outer vertical edge 525 (FIGS. 22A-22E) that is shown continuing to form the first edge or outer edge 527 of the flange 516. The wall 512 also forms a second or an inner vertical edge 526 which is shown continuing to form the second or inner edge 528 of the flange 516. The knuckle pin 510 may be utilized in a standard coupling arrangement, such as the coupler and knuckle system depicted in FIGS. 9-15 (shown with the pin 110).

The knuckle pin 510, though not shown in the figures, may be provided with a lower retainer, which may comprise one or more of apertures in the lower portion 515, which preferably extend through the overlaps of the wall 512, and being provided on opposite sides thereof (to receive a cotter pin or key, as shown and described in connection with the other pin embodiments). Alternatively, tabs or legs may be provided in the lower portion of the wall 512 that may be bent upward, as shown and described in connection with the legs of the other pin embodiments herein. The edge of the inner wall 526 and edge of the outer wall 525 are free and may move upon encountering forces. The wall 512 may undergo compressive forces and expansive forces with the impact of the forces being handled or distributed by the movement of the wall 512 and flange 516. The pin 510 preferably is constructed from a suitable material, preferably steel, and has a suitable thickness, so that upon receiving a load that deflects or moves the pin 510 or portion thereof, the pin body 511, and, in particular the wall 512 and flange 516 may return to their initial positions or conditions.

Figure 26:
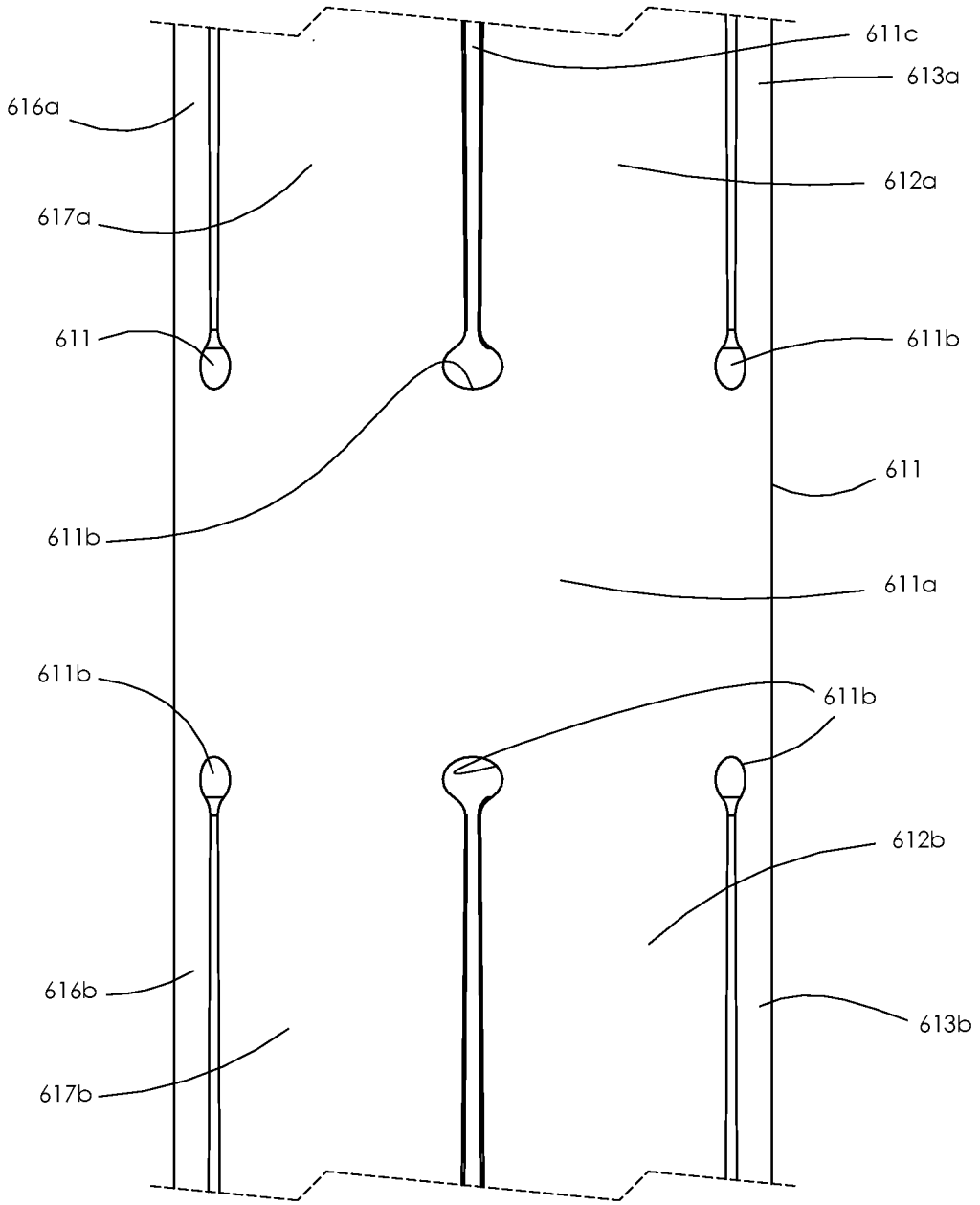
FIG. 26 is a front elevation view of a portion of the knuckle pin of FIG. 24A showing the spacing between the segments.

Referring to FIGS. 24A-24E, 25A, 25B and 26, an alternate embodiment of a pin 610 is shown having a body 611 with a central portion 611*a*. The body has an opening 629 therein The body 611 is preferably circumferential or curved, and has a plurality of upper segments 612*a*, 613*a*, 614*a*, 615*a*, 616*a*, and 617*a*, and lower segments 612*b*, 613*b*, 614*b*, 615*b*, 616*b*, and 617*b* (615*b* being out of view and located diametrically opposite of 612*b*). A plurality of separations or spaces are shown between adjacent upper segments 612*a*, 613*a*, 614*a*, 615*a*, 616*a*, and 617*a*, and a plurality of separations or spaces are shown between adjacent lower segments 612*b*, 613*b*, 614*b*, 615*b*, 616*b*, and 617*b*. The spaces between adjacent segments widen along the vertical length of the space from the central location 611*a* to a respective pin end 651, 652. Preferably, the space width, widening is accomplished by a narrowing of the segments along the vertical segment length of the segment from the central location 611*a* to a respective pin end 651, 652. The upper segments 612*a*, 613*a*, 614*a*, 615*a*, 616*a*, and 617*a* preferably form flanges 632, 633, 634, 635, 636 and 637, respectively at their respective terminal ends. The lower segments 612*b*, 613*b*, 614*b*, 615*b*, 616*b*, and 617*b* preferably terminate along their vertical lengths. According to preferred embodiments, a bore 611*b* is provided in the body wall 611 at the locations where each space between the segment begins, so as to accommodate movement of the upper and lower segments in response to a force load imparted on the pin 610. Referring to FIG. 26, an example of the spacing is illustrated, where the space 611*c* is shown between two adjacent upper segments 617*a* and 612*a*, and the space 611*c* shown widening from the central location 611*a* where the space 611*c* meets the bore 611*b*. The upper segments 617*a* and 612*a* preferably have tapering circumferential portions and narrow in their circumferential width from the central portion 611*a* to the flanges at the pin end 651. The upper segments and lower segments may be deflected independent of one another, or together, depending on the force load received (direction from which the loading takes place, and the intensity of the force or load). The pins herein, including the pin 610 are provided to handle impacts that may be sudden, as well as force loads that may increasingly evolve. The spaced apart segments and flanges provide for lateral, radial, as well as circumferential movement in response to a force load to handle and deflect or dissipate force loads that the pin 610 receives.

Figure 27:
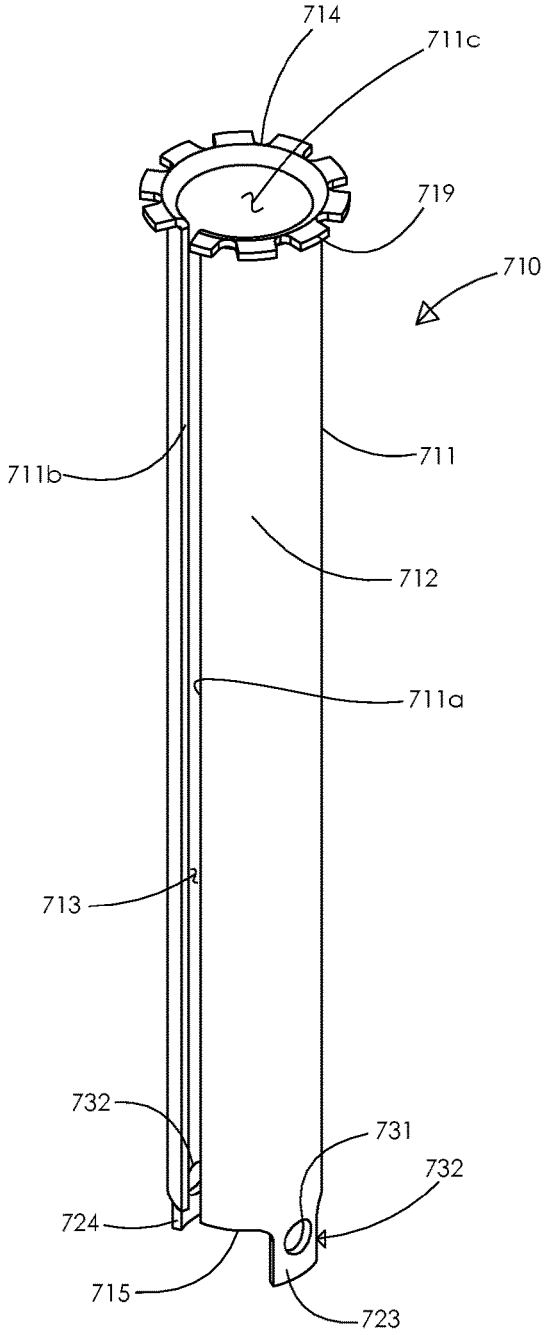
FIG. 27 is a perspective view of a sixth embodiment of a knuckle pin according to the invention.
Figure 28:
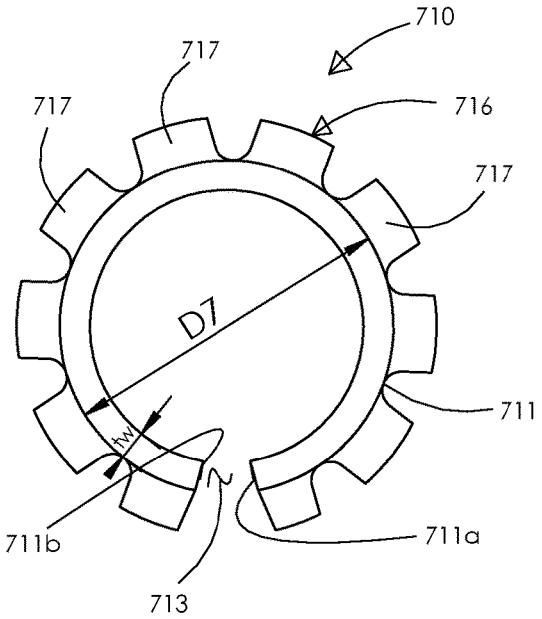
FIG. 28 is a top plan view of the knuckle pin of FIG. 27.

Referring to FIGS. 27 and 28, an embodiment of a knuckle pin 710 is shown similar to the pin 110 shown in FIGS. 1-15. The pin 710 has a cylindrical body 711 that includes a cylindrical body wall 712 with a space 713 therein, and a longitudinal separation between vertical ends 711*a*, 711*b* of the body 711. The longitudinal separation 713 extends the length of the pin body 711. The pin 710 has an upper end 714 and a lower end 715. The longitudinal slot 713 is shown spanning the length of the pin body wall 712.

The pin 710 has a first or upper retainer 716 disposed at the upper portion 114 and extending wider than the diameter D7 of the pin body 711. The upper retainer 716 is shown comprising a plurality of flanges 717, which are spaced apart from each other.

According to a preferred embodiment, the spaces 718 between adjacent flanges 717 are curved and more preferably, according to preferred embodiments are parabolic. As shown in FIG. 27, each flange 716 preferably has a thickness 719. According to preferred embodiments, the flange thickness 719 may have a thickness that is the same as the thickness of the wall 711 (tw) (FIG. 28).

The pin 710 is shown having a lower or second retainer 722, which comprises a pair of legs 723, 724 and apertures 731, 732, and functions similar to the retainer 122 and legs shown and described in connection with the pin 110.

Figure 29:
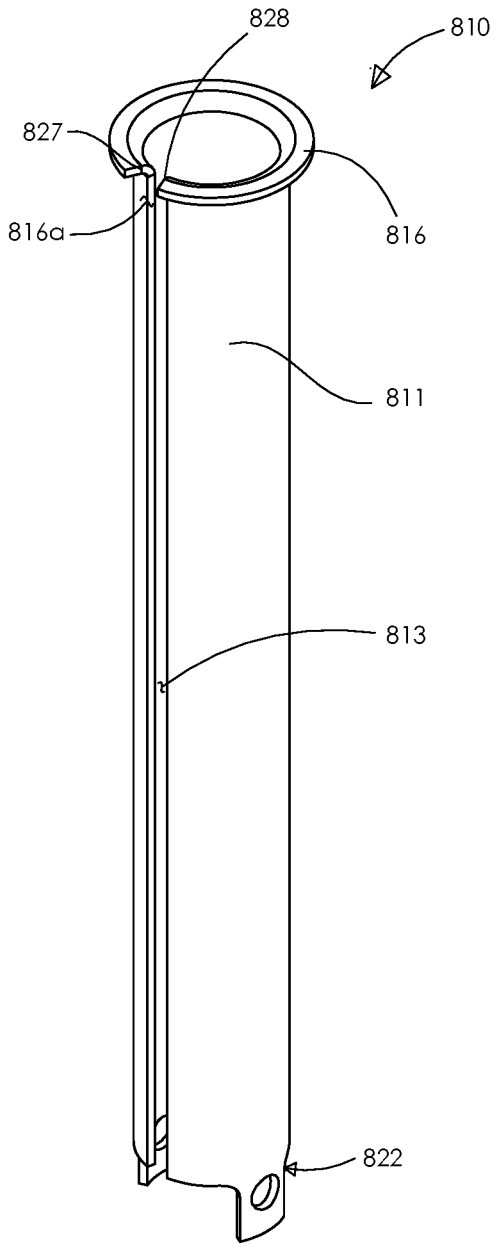
FIG. 29 is a perspective view of a seventh embodiment of a knuckle pin according to the invention.
Figure 30:
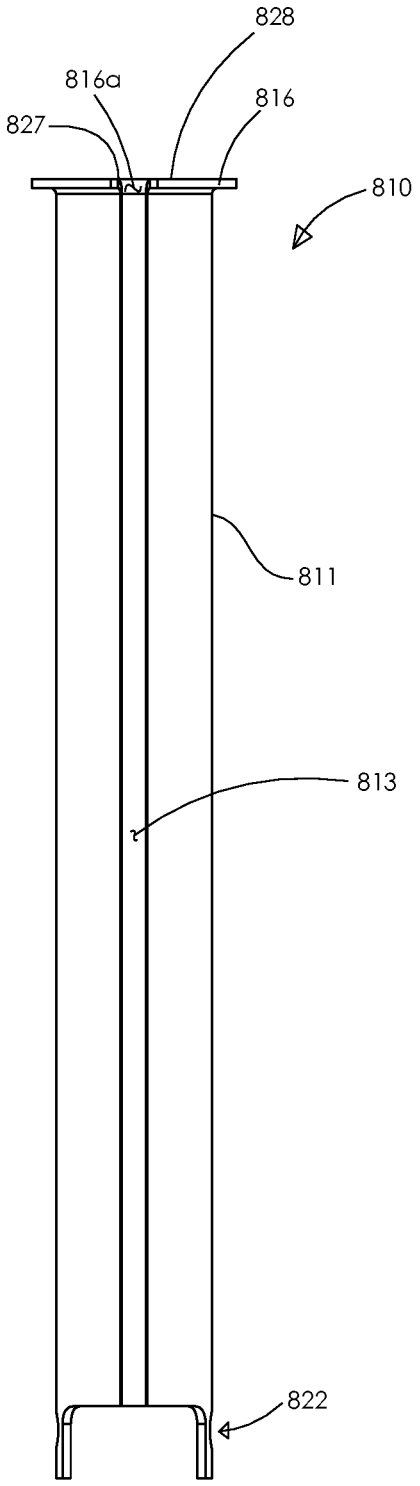
FIG. 30 is a front elevation view of the knuckle pin of FIG. 29.
Figure 31:
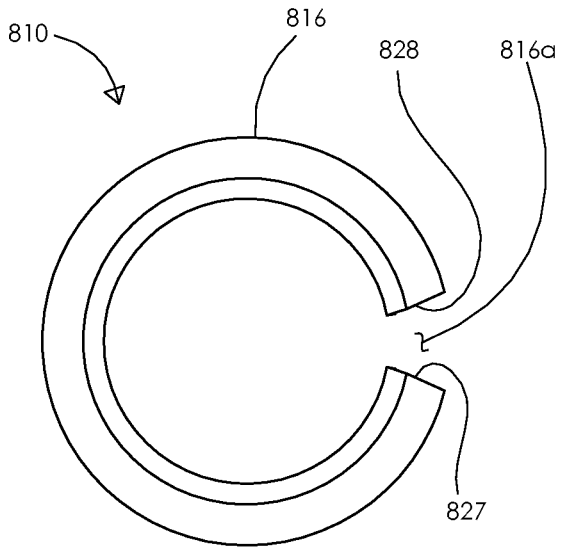
FIG. 31 is a top plan view of the knuckle pin of FIG. 29.

Referring to FIGS. 29-31, a pin 810 is shown, and is similar to the pins 110 and 710, expect that the pion includes an upper retainer comprising a continuous flange 816. The flange 816 is shown connected to the body wall 811. A longitudinal slot 813 also is shown and extends to form a slot 816*a* separating the flange wall edges 827, 828. A lower retainer 822 also is shown, and is similar to the lower retainers shown and described herein in connection with the other embodiments.

Figure 32:
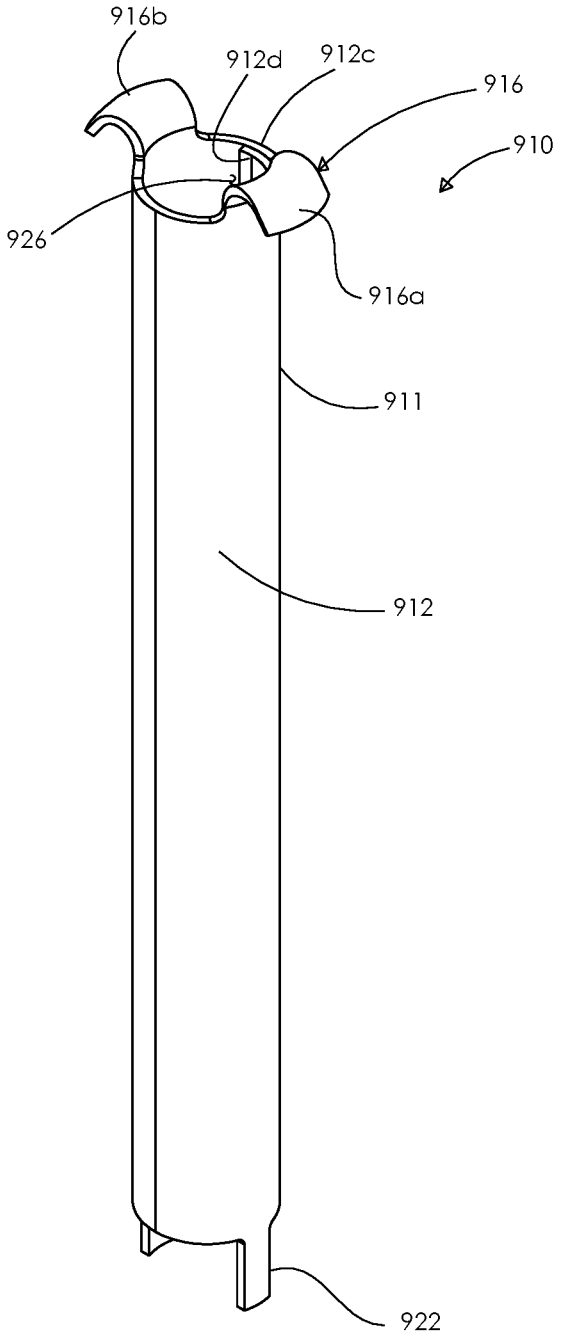
FIG. 32 is a perspective view of an eighth embodiment of a knuckle pin according to the invention.
Figure 33:
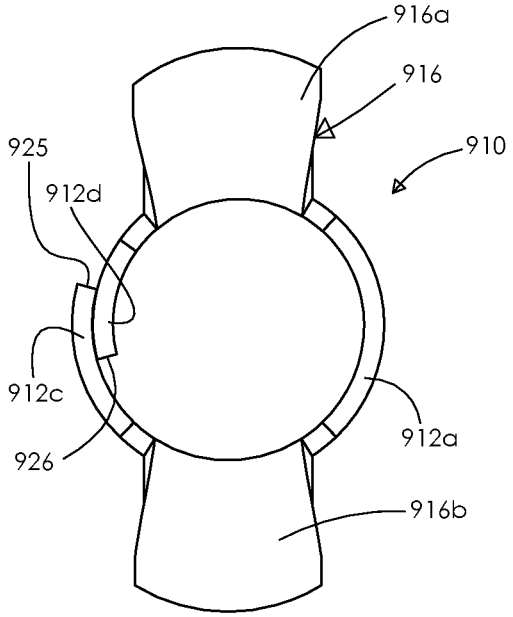
FIG. 33 is a top plan view of the knuckle pin of FIG. 32.

Referring to FIGS. 32-33 an alternate embodiment of a knuckle pin 910 is shown comprising a body 911 having a wall 912 that preferably is cylindrical or curved, and overlaps itself. The wall 912 at least in part, overlaps itself. According to preferred embodiments, the wall 912 preferably is concentric, and more preferably spirally concentric. The wall 912 may have an increasing or decreasing radius as the circumference of the wall 912 turns to partially overlap itself.

An upper flange portion 916 is shown and has a span that is wider than the cylindrical or curved body wall 912. The upper flange 916, comprising a first flange portion 916*a* and second flange portion 916*b*, is shown according to a preferred embodiment as an extension of the wall 912. The wall 912 has at least a portion 912*c*, 912*d*, which overlap. makes at least one overlap with itself (represented by the broken lines of the wall thickness). The wall 912 has a thickness 912*a* and an first edge or outer vertical edge 925 (FIG. 33) and a second or an inner vertical edge 926. The knuckle pin 910 may be utilized in a standard coupling arrangement, such as the coupler and knuckle system depicted in FIGS. 9-15 (shown with the pin 110). The knuckle pin 910 has a lower retainer 922, and although shown with legs 923, 924 apertures also may be provided. According to preferred embodiments the overlap of the wall 912 is situated to that the lower legs 923, 924 of the retainer are not located directly in line with an overlapping wall portion. According to some preferred embodiments, the legs are located in linear relation to the location of the flange portions 916*a*, 916*b*.

Figure 34:
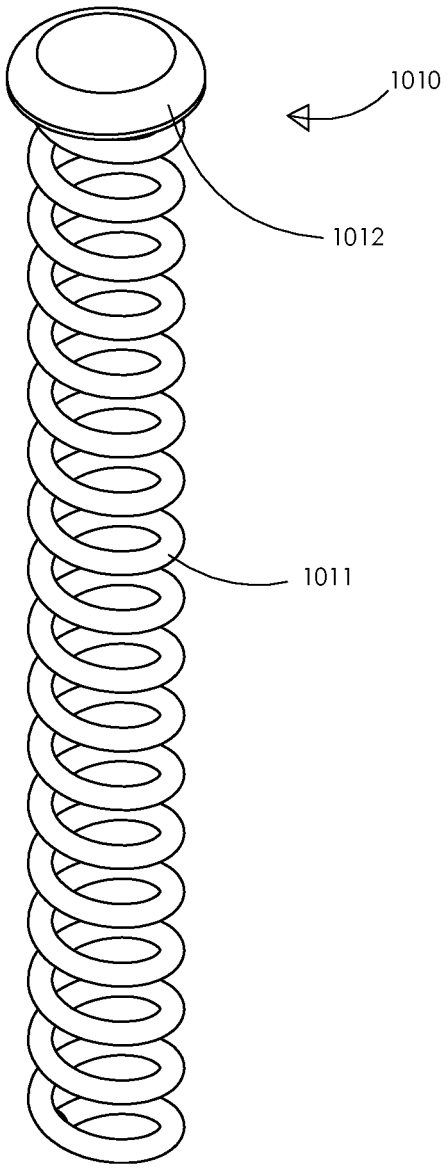
FIG. 34 is a perspective view of an ninth embodiment of a knuckle pin according to the invention.
Figure 35:
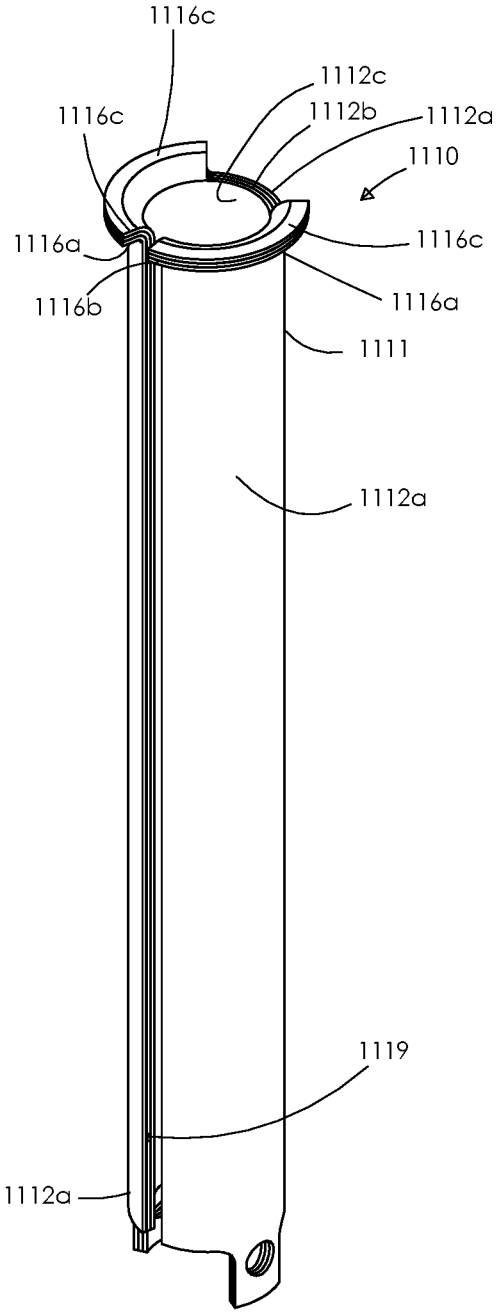
FIG. 35 is a perspective view of a tenth embodiment of a knuckle pin according to the invention.

Referring to FIG. 34, an alternate embodiment of a knuckle pin 1010 is shown having a spiral body 1011 and a head 1012. The head 1012 preferably comprises an upper retainer. According to preferred embodiments, the head 1012 has a diameter that is larger than the body 1011 for maintaining the pin 1010 in a coupling arrangement (see e.g., FIGS. 9-15). Though not shown, lower retaining means comprising a retainer, such as apertures for receiving a cotter pin or key, or bendable legs, may be provided.

Figure 36:
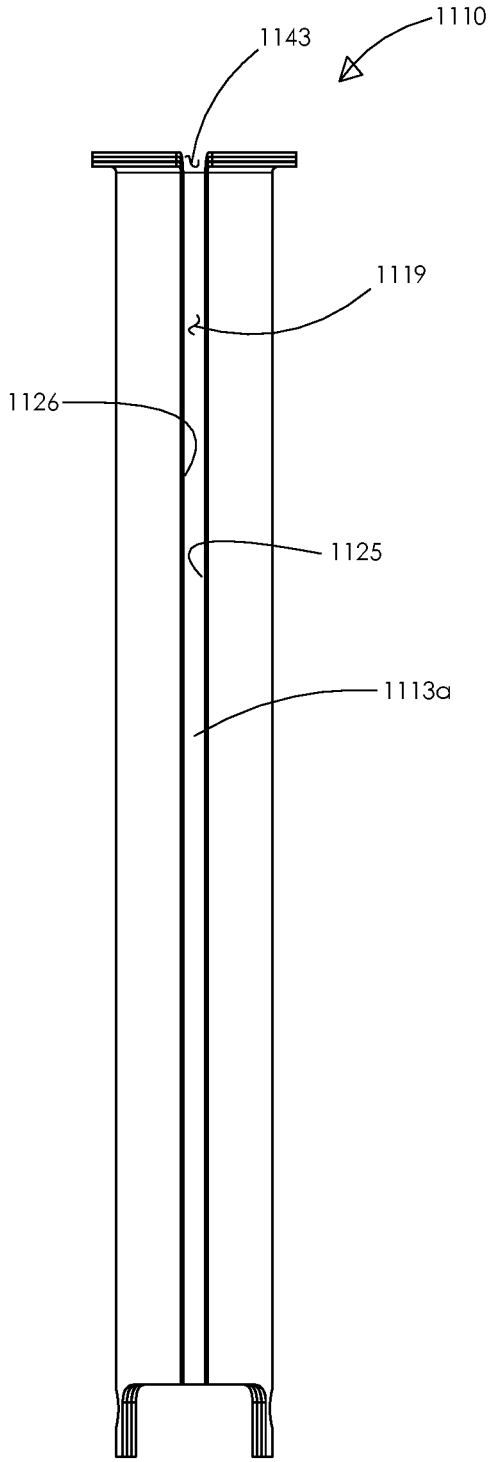
FIG. 36 is a front elevation view of the pin of FIG. 35.
Figure 37:
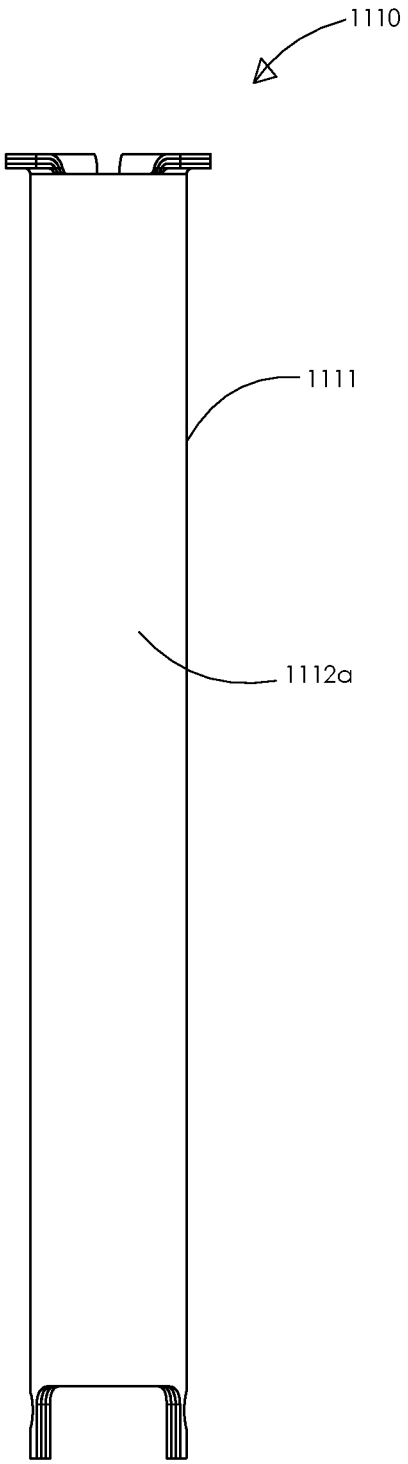
FIG. 37 is a rear elevation view of the pin of FIG. 35.
Figure 38:
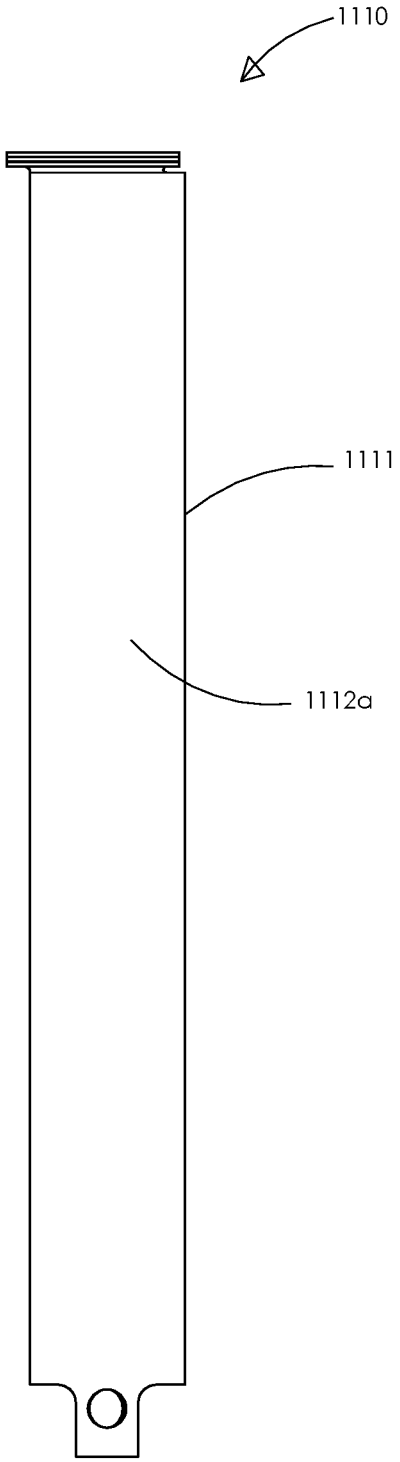
FIG. 38 is a right side elevation view of the pin of FIG. 35.
Figure 39:
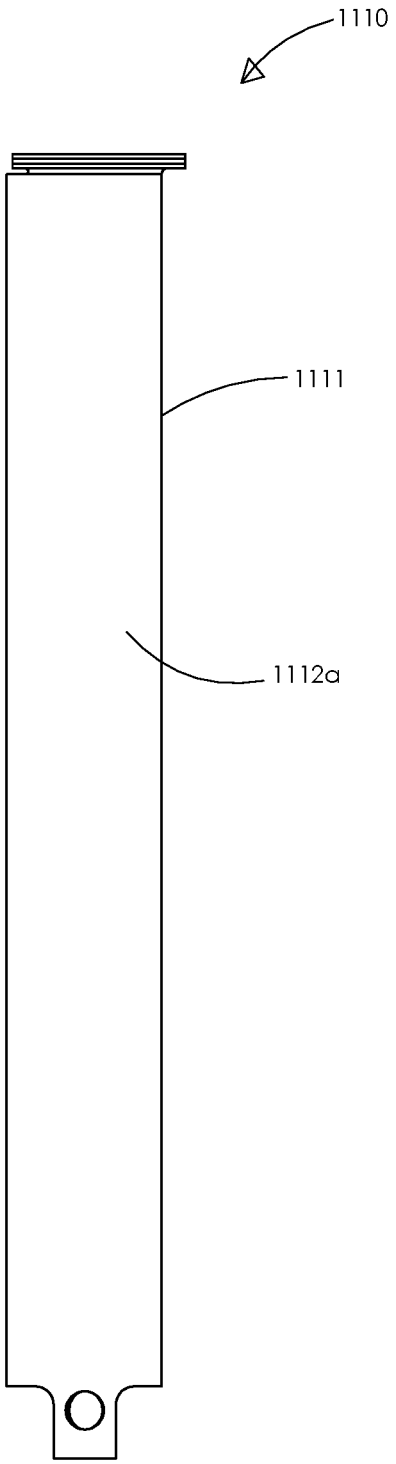
FIG. 39 is a left side elevation view of the pin of FIG. 35.
Figure 40:
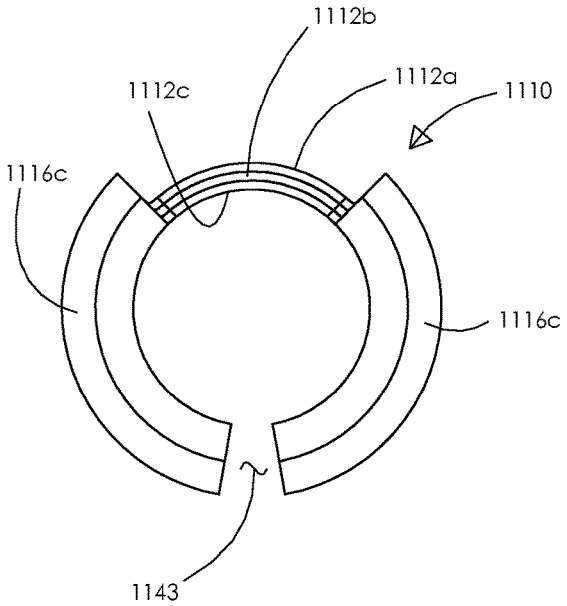
FIG. 40 is a top plan view of the pin of FIG. 35.
Figure 41:
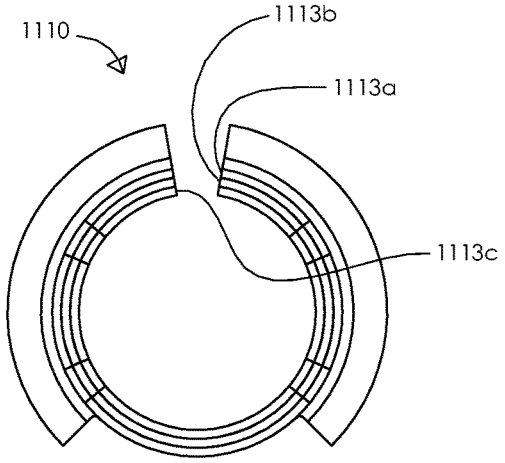
FIG. 41 is a bottom plan view of the pin of FIG. 35

Referring to FIGS. 35-41, an alternate embodiment of a stacked pin 1110 is shown including a body 1111 that is comprised of three portions, including a first portion 1112*a* serving as the outer portion, a second portion 1112*b* serving as a middle portion, and a third portion 1112*c*, serving as an inner portion and comprising the inner wall. The third portion 1112*c* preferably inserts within the second portion or wall 1112*b*. According to preferred embodiments, the flanges 1116*a*, 1116*b* and 1116*c* may nest on each other. The flanges 1116*a*, 1116*b* and 1116*c* in the embodiment illustrated preferably are spaced apart and comprise a first segment and a second segment. In the embodiment illustrated, each body portion 1112*a*, 1112*b*, 1112*c*, is shown having a vertical slot or opening 1113*a*, 1113*b*, 1113*c* that are aligned to form an opening 1119 along the pin vertical length. Preferably the body portions may comprise separate components that may be stacked and nested within each other, as shown in the exemplary illustrations. The vertical walls of each body portion 1112*a*, 1112*b*, 1112*c* defining the respective vertical slots or openings 1113*a*, 1113*b*, 1113*c*, preferably extend to form an opening between 1143 between the flange portions (see FIG. 36). As shown in FIG. 36, the outer body portion 1112*a* is shown forming the outer wall space or slot 1113*a*, which with the other body portion spaces 1113*b*, 1113*c*, forms the vertical opening 1119. The spaces provides a longitudinal separation between respective vertical ends of the body portions, such as the space 1113*a* provides for vertical ends 1125, 1126 of the outer wall 1112*a*. The vertical ends or edge portions 1125, 1126 of the wall 1112*a* are shown turning from their vertical orientation to form a flange opening 1143 between the wall edges 1125, 1126.

Similar to the other pins shown and described herein, the pin 1110 may include retaining means at the lower portion. As discussed herein, the lower retainer may comprise legs provided on one or more of the wall portions, and as shown in the preferred embodiments, may be provided on each wall portion. According to some implementations, a single opposing leg paid may be bent upwardly for retention, while the other legs remain in their vertical position. Alternatively, a pin may be installed, with each of the legs remaining in the unbent or vertical position. Other embodiments may be provided with a single pair of legs on at least one of the walls forming the pin.

In addition, preferred materials used to produce the pin, such as steel, also do not degrade in the presence of exposure to environmental elements, and can withstand cool and hot environmental temperatures.

While the invention has been described with reference to specific embodiments, the description is illustrative and is not to be construed as limiting the scope of the invention. Various modifications and changes may occur to those skilled in the art without departing from the spirit and scope of the invention described herein and as defined by the appended claims. It is intended that the foregoing detailed description be regarded as illustrative rather than limiting, and that it be understood that it is the following claims, including all equivalents, that are intended to define the spirit and scope of this invention.

What is claimed is:

1. A knuckle pin for use in a coupler assembly of a railway vehicle, comprising:

a) a cylindrical body with an upper end and a lower end;
b) a slot in the cylindrical body;
c) the cylindrical body having a first vertical edge and a second vertical edge;
d) the first and second vertical edges defining the slot e) a first retaining feature and a second retaining feature;
f) wherein the first retaining feature is located at the upper end, and where the second retaining feature is located the lower end; and
g) wherein a wall forms the cylindrical body and the second retaining feature, wherein the wall defines an inner space that communicates with the vertical slot, and wherein the second retaining feature comprises at least one bendable leg that is movable between positions, including a first position for installation of the pin into and removal of the pin from the coupler assembly, and a second position that retains the pin on the coupler assembly.

2. The knuckle pin of claim 1, the first retaining feature comprising a plurality of elements that are connected to the pin body and extend beyond the circumference of the pin body.

3. The knuckle pin of claim 2, wherein the second retaining feature comprises opposing apertures provided in the cylindrical body at the lower end thereof.

4. The knuckle pin of claim 2, wherein the second retaining feature comprises a plurality of bendable legs disposed at the lower end of the cylindrical body that are movable in a direction outward of the circumference of the cylindrical body.

5. The knuckle pin of claim 1, wherein the second retaining feature comprises opposing apertures provided in the wall.

6. The knuckle pin of claim 1, wherein the second retaining feature comprises a plurality of bendable legs disposed at the lower end of the cylindrical body that are movable in a direction outward of the circumference of the cylindrical body.

7. The knuckle pin of claim 1, wherein the pin in constructed from steel.

8. The knuckle pin of claim 7, wherein the pin is formed from a substantially flat piece of steel that is cut and rolled to form the pin.

9. The knuckle pin of claim 1, wherein a plurality of slots are provided in the cylindrical body and are vertically disposed, the cylindrical body having a plurality of spaced apart segments, wherein said plurality of spaced apart segments form a circumference of the body and are spaced apart by said plurality of slots.

10. A knuckle pin for use in a coupler assembly to secure a knuckle to a coupler, the knuckle pin comprising:

a cylindrical body portion having a first end and a second end, a slot disposed along the length of the body portion;

the body portion including a first retainer at the first end, said first retainer being wider than the diameter of the cylindrical body portion;

a second retainer at the second end, the second retainer comprising legs extending downward from the cylindrical body portion, wherein the body portion and the second retainer legs comprise a wall having a wall thickness, said wall thickness defining the thickness of said second retainer legs and said body portion, and wherein said second retainer legs are movable relative to said body portion.

11. A coupling system assembly, including a coupler knuckle, a coupler, and a knuckle pin pivotally connecting the knuckle with the coupler, the knuckle pin having:

a) a cylindrical body with an upper end and a lower end;
b) a slot in the cylindrical body;
c) the cylindrical body having a first vertical edge and a second vertical edge;
d) the first and second vertical edges defining the slot;
e) a first retaining feature and a second retaining feature;
f) wherein the first retaining feature is located at the upper end, and where the second retaining feature is located the lower end;
g) wherein the coupler has an upper pivot lug and a lower pivot lug, and wherein the knuckle is seated within the upper pivot lug and the lower pivot lug,
h) wherein the pin passes through the upper pivot lug, the knuckle, and the lower pivot lug;
i) wherein the first retaining feature engages the coupler upper pivot lug, the first retaining feature being a stop to prevent further lowering of the pin; and
j) wherein the second retaining feature acts as a stop to retain the pin in the assembly, and
k) wherein a wall having a wall thickness forms the cylindrical body and the second retaining feature, wherein the wall defines an inner space that communicates with the vertical slot, and wherein the second retaining feature comprises at least one bendable leg that is movable between positions, including a first position for installation and removal of the pin, where the leg is insertable into and removable from the upper pivot lug, the knuckle, and the lower pivot lug, and a second position where the at least one bendable leg engages the lower pivot lug to retain the pin on the coupling system assembly.

12. The coupling system assembly of claim 11, wherein the second retaining feature comprises a plurality of bendable legs disposed at the lower end of the cylindrical body that are movable in a direction outward of the circumference of the cylindrical body.

13. A method for producing a knuckle pin having:

a) a cylindrical body with an upper end and a lower end;

b) a slot in the cylindrical body;

c) the cylindrical body having a first vertical edge and a second vertical edge;

d) the first and second vertical edges defining the slot;

e) a first retaining feature and a second retaining feature;

f) wherein the first retaining feature is located at the upper end, and where the second retaining feature is located the lower end;

the method comprising:

providing a workpiece;

stamping the workpiece;

rolling the workpiece, wherein rolling the workpiece forms the cylindrical body and wherein rolling the workpiece is carried out to produce a slot in the cylindrical body between the first and second vertical edges.

14. The method of claim 13, wherein said second retaining feature comprises at least one movable leg, and wherein said at least one movable leg is formed along with the cylindrical body during the stamping and the rolling of the workpiece.

15. The method of claim 14, wherein said second retaining feature comprises at least two movable legs, and wherein said at least two movable legs are formed along with the cylindrical body during the stamping and the rolling of the workpiece.

16. The method of claim 15, wherein said at least two movable legs are formed to oppose each other.

17. A knuckle pin for use in a coupler assembly of a railway vehicle, comprising:

a) a cylindrical body with an upper end and a lower end;

b) a slot in the cylindrical body;

c) the cylindrical body having a first vertical edge and a second vertical edge;

d) the first and second vertical edges defining the slot;

e) a first retaining feature and a second retaining feature;

f) wherein the first retaining feature is located at the upper end, and where the second retaining feature is located the lower end; and g) wherein the pin is comprised of a plurality of cylindrical bodies.

18. The knuckle pin of claim 17, wherein said plurality of cylindrical bodies are nested within each other.

19. The knuckle pin of claim 17, wherein said cylindrical body comprises a first cylindrical body, and including a second cylindrical body with an upper end and a lower end; a slot in the second cylindrical body, the second cylindrical body having a first vertical edge and a second vertical edge, said second cylindrical body first and second vertical edges defining the second cylindrical body slot, and wherein at least one of said first cylindrical body and said second cylindrical body is received within the other of said first cylindrical body and said second cylindrical body.

20. The knuckle pin of claim 19, wherein said first cylindrical body slot is positioned so that the second cylindrical body is covering said first cylindrical body slot, and wherein said second cylindrical body slot is positioned so that the first cylindrical body is covering said second cylindrical body slot.

21. The knuckle pin of claim 19, including a third cylindrical body with an upper end and a lower end; a slot in the third cylindrical body, the third cylindrical body having a first vertical edge and a second vertical edge, said third cylindrical body first and second vertical edges defining the third cylindrical body slot, and wherein said first cylindrical body, said second cylindrical body, and said third cylindrical body are stacked, such that the first cylindrical body forms an outer layer, the second cylindrical body forms a second layer, and the third cylindrical body forms an inner layer.

* * * * *